US008807386B2

(12) United States Patent
Lam

(10) Patent No.: US 8,807,386 B2
(45) Date of Patent: Aug. 19, 2014

(54) ACCESSORY FOR DRINKING VESSEL

(75) Inventor: Chi Shing Lam, Hong Kong (CN)

(73) Assignee: Great Fortune (HK) Limited, Hong Kong (CN)

( * ) Notice: Subject to any disclaimer, the term of this patent is extended or adjusted under 35 U.S.C. 154(b) by 13 days.

(21) Appl. No.: 13/001,803

(22) PCT Filed: May 17, 2010

(86) PCT No.: PCT/CN2010/072826

§ 371 (c)(1),
(2), (4) Date: Dec. 29, 2010

(87) PCT Pub. No.: WO2010/133154

PCT Pub. Date: Nov. 25, 2010

(65) Prior Publication Data

US 2011/0121008 A1 May 26, 2011

(30) Foreign Application Priority Data

May 19, 2009 (GB) ..... 0908652.1

(51) Int. Cl.

| | |
|---|---|
| ***A47G 19/22*** | (2006.01) |
| ***A61J 9/04*** | (2006.01) |
| ***A61J 11/00*** | (2006.01) |
| ***A47G 21/18*** | (2006.01) |

(52) U.S. Cl.

CPC ..... *A47G 19/2272* (2013.01); *A61J 9/04* (2013.01); *A61J 11/002* (2013.01); *A47G 21/18* (2013.01)

USPC ..... 220/711; 220/714; 220/703; 220/203.1; 220/203.2; 220/373; 215/11.4; 215/11.5; 215/311; 215/307

(58) Field of Classification Search

CPC ... A47G 19/2272; A47G 21/18; A61J 11/002; A61J 9/04

USPC ..... 220/203.02, 711, 714, 203.1–203.2, 220/373, 367.1, 374, 703; 215/311, 307, 215/11.4–11.5; 222/547, 562, 566–567

See application file for complete search history.

(56) References Cited

U.S. PATENT DOCUMENTS 670,794 A * 3/1901 Lott ..... 137/844
3,104,787 A * 9/1963 Thompson, Jr. ..... 222/490

(Continued)

FOREIGN PATENT DOCUMENTS

WO W096/11569 A1 4/1996
WO W01/97663 A 12/2001

OTHER PUBLICATIONS

International Search Report, mailed Sep. 2, 2010.

(Continued)

*Primary Examiner* — Andrew Perreault
*Assistant Examiner* — James M Van Buskirk
(74) *Attorney, Agent, or Firm* — William J. Sapone; Ware Fressola Maguire & Barber LLP

(57) ABSTRACT

An accessory for a drinking vessel is disclosed as including a body (102) with a passageway allowing air or liquid to pass through, the body including a first wall (104*a*) and a second wall (104*b*) which are opposite to each other, and a valve (110) in the passageway, the valve (110) including a first valve member (110*a*) and a second valve member (110*b*), in which both the first and second valve members (110*a*, 110*b*) are integrally formed with the first and second walls, and each of the first and second valve members (110*a*, 110*b*) includes respectively a first surface (111*a*, 111*c*) and a second surface (111*b*, 111*d*) which are opposite to each other, in which the first surfaces of the first and second valve members face generally a first direction, and the second surfaces of the first and second valve members face generally a second direction which is opposite to the first direction, and the first valve member is deformable between a first configuration in which at least part of the second surface of the first valve member contacts and overlaps at least part of the first surface of the second valve member to prevent flow of air or liquid through the valve and a second configuration in which the first valve member is out of contact with the second valve d member to allow flow of air or liquid through the valve.

37 Claims, 25 Drawing Sheets

(56) References Cited

U.S. PATENT DOCUMENTS

| | | | | | |
|---|---|---|---|---|---|
| 3,915,331 | A | | 10/1975 | Chenault | |
| 4,782,975 | A | * | 11/1988 | Coy | 220/711 |
| 5,035,340 | A | * | 7/1991 | Timmons | 215/11.4 |
| 5,553,726 | A | * | 9/1996 | Park | 215/11.4 |
| 5,564,480 | A | * | 10/1996 | Chen | 141/65 |
| 5,860,541 | A | * | 1/1999 | McIntyre et al. | 215/11.4 |
| 5,890,621 | A | | 4/1999 | Bachman et al. | |
| 6,116,457 | A | | 9/2000 | Haberman | |
| 6,230,923 | B1 | * | 5/2001 | Hung | 220/703 |
| 7,234,607 | B2 | * | 6/2007 | Dunn et al. | 215/11.5 |
| 7,556,172 | B2 | | 7/2009 | Lane | |
| 2001/0027956 | A1 | * | 10/2001 | Bonacorso et al. | 215/11.1 |
| 2002/0158075 | A1 | | 10/2002 | Caldicott et al. | |
| 2005/0184075 | A1 | | 8/2005 | Belcastro | |
| 2006/0108373 | A1 | | 5/2006 | Cheng | |

OTHER PUBLICATIONS

Supplemental European Search Report for corresponding application EP 10777357, mailed Jan. 30, 2013, 3 pages.

* cited by examiner

Fig. 85
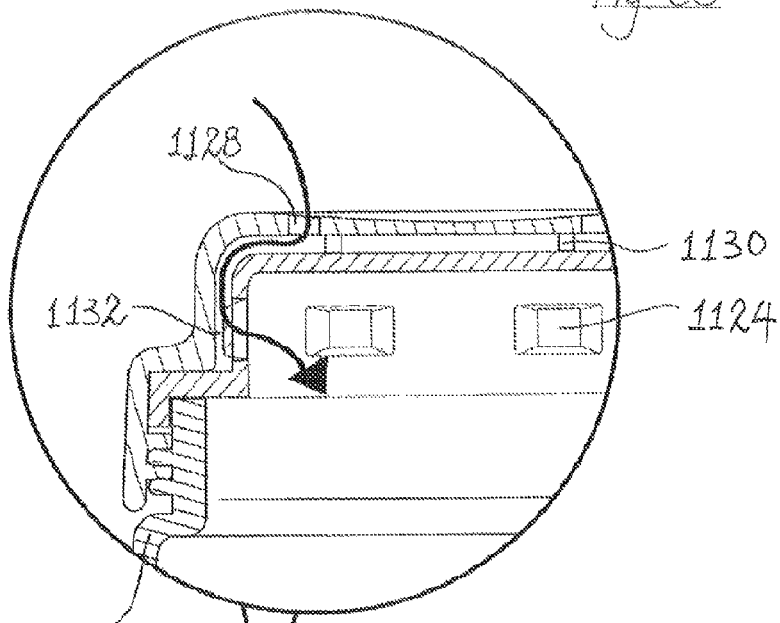
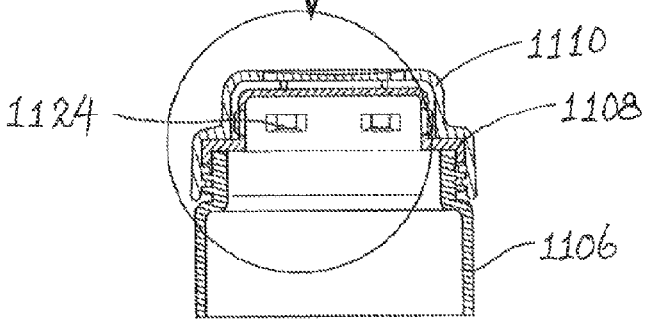
Fig. 84

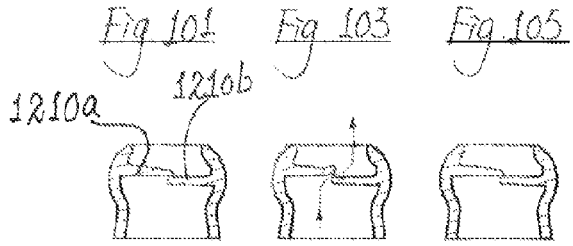
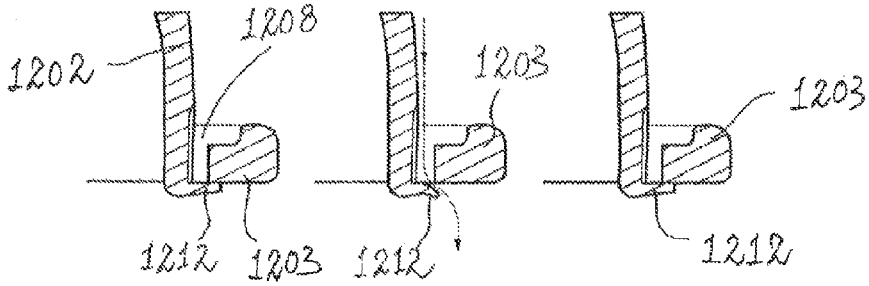
Fig 102 Fig 104 Fig 106
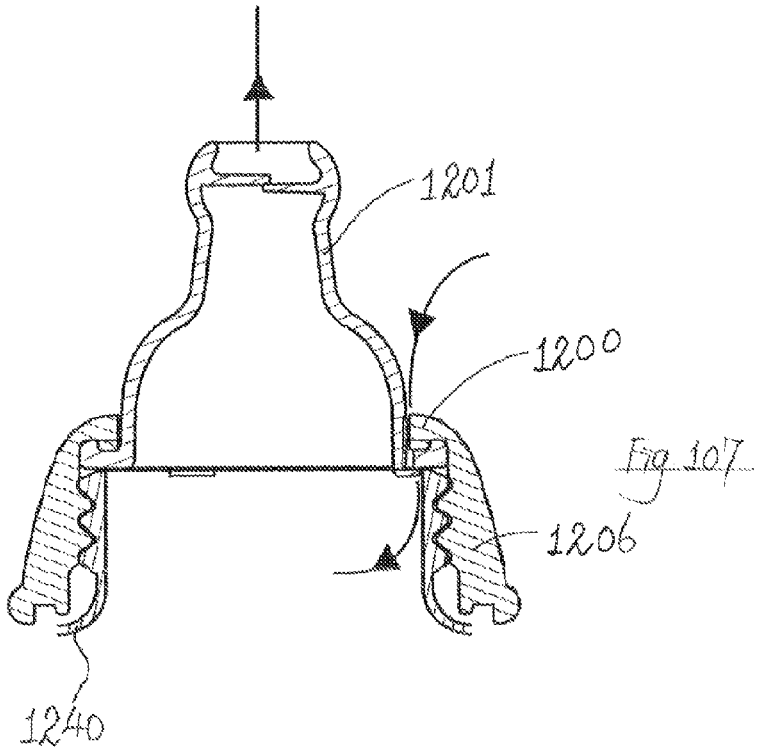
Fig 107

ACCESSORY FOR DRINKING VESSEL

This invention relates to an accessory for a drinking vessel, and in particular such an accessory with a valve.

BACKGROUND OF THE INVENTION

There are in existence various accessories, e.g. spill-proof lids, which are designed for use with drinking vessels, e.g. cups, for preventing or at least minimizing out-flow of content from the cups when, for example, the cups are accidentally knocked over. Such lids or cups are generally very complicated in structure and thus of a high production cost. It is also generally known that when toddlers start to use straws for drinking from cups with a lid, they are prone to knock off the cups, thus spilling the content of the cups through the straws. In addition, when a baby is bottle-fed, air bubbles will form in the feeding bottle and be ingested by the baby. This will cause posseting, in which the baby vomits from time to time after feed and may also bring up small amounts of milk when they burp. The baby may need winding to ease it from the discomfort of posseting.

It is thus an object of the present invention to provide an accessory for a drinking vessel and a drinking vessel with such an accessory in which the aforesaid shortcomings are mitigated, or at least to provide a useful alternative to the trade and public.

SUMMARY OF THE INVENTION

According to a first aspect of the present invention, there is provided an accessory for a drinking vessel, said accessory including a body with at least one passageway allowing air or liquid to pass through, wherein said body includes a first wall and a second wall which are opposite to each other, and at least a first valve in said passageway, wherein said first valve includes at least a first valve member and a second valve member, wherein said first valve member is integrally formed with said first and second walls, wherein said second valve member is integrally formed with said first and second walls, wherein each of said first and second valve members includes respectively a first surface and a second surface which are opposite to each other, wherein said first surfaces of said first and second valve members face generally a first direction, wherein said second surfaces of said first and second valve members face generally a second direction which is opposite to said first direction, and wherein said first valve member is deformable between a first configuration in which at least part of said second surface of said first valve member contacts and overlaps at least part of said first surface of said second valve member to prevent flow of air or liquid through said first valve and a second configuration in which said first valve member is out of contact with said second valve member to allow flow of air or liquid through said first valve.

According to a second aspect of the present invention, there is provided a drinking vessel including a container with an open upper end and an accessory for a drinking vessel, said accessory including a body with at least one passageway allowing air or liquid to pass through, wherein said body includes a first wall and a second wall which are opposite to each other, and at least a first valve in said passageway, wherein said first valve includes at least a first valve member and a second valve member, wherein said first valve member is integrally formed with said first and second walls, wherein said second valve member is integrally formed with said first and second walls, wherein each of said first and second valve members includes respectively a first surface and a second surface which are opposite to each other, wherein said first surfaces of said first and second valve members face generally a first direction, wherein said second surfaces of said first and second valve members face generally a second direction which is opposite to said first direction, and wherein said first valve member is deformable between a first configuration in which at least part of said second surface of said first valve member contacts and overlaps at least part of said first surface of said second valve member to prevent flow of air or liquid through said first valve and a second configuration in which said first valve member is out of contact with said second valve member to allow flow of air or liquid through said first valve, wherein said accessory is releasably engageable with said open upper end of said container, wherein said accessory is a lid, and wherein said body of said accessory includes a spout.

According to a third aspect of the present invention, there is provided a drinking vessel including a container with an upper open end and a lower open end, an accessory, and a cover, said accessory including a body with at least one passageway allowing air or liquid to pass through, wherein said body includes a first wall and a second wall which are opposite to each other, and at least a first valve in said passageway, wherein said first valve includes at least a first valve member and a second valve member, wherein said first valve member is integrally formed with said first and second walls, wherein said second valve member is integrally formed with said first and second walls, wherein each of said first and second valve members includes respectively a first surface and a second surface which are opposite to each other, wherein said first surfaces of said first and second valve members face generally a first direction, wherein said second surfaces of said first and second valve members face generally a second direction which is opposite to said first direction, wherein said first valve member is deformable between a first configuration in which at least part of said second surface of said first valve member contacts and overlaps at least part of said first surface of said second valve member to prevent flow of air or liquid through said first valve and a second configuration in which said first valve member is out of contact with said second valve member to allow flow of air or liquid through said first valve, and wherein said accessory includes an endless wall and a bottom wall member adjoining said endless wall member and collectively defining an internal cavity.

BRIEF DESCRIPTION OF THE DRAWINGS

Embodiments of the present invention will now be described, by way of examples only, with reference to the accompanying drawings, in which:

FIG. 84 is a further longitudinal sectional view of the bottom portion of the bottle of FIG. 81 in an upside down orientation;

FIG. 85 is an enlarged view of the encircled part of FIG. 84;

FIG. 101 is a view of the encircled part marked A in FIG. 98 in a valve-closed configuration;

FIG. 102 is an enlarged view of the encircled part marked B in FIG. 98 in a vent-closed configuration;

FIG. 103 is a view of the encircled part marked A in FIG. 98 in a valve-open configuration;

FIG. 104 is an enlarged view of the encircled past marked B in FIG. 98 in a vent-open configuration;

FIG. 105 is a view of the encircled part marked A in FIG. 98 after resuming a valve-closed configuration;

FIG. 106 is an enlarged view of the encircled past marked B in FIG. 98 after resuming a vent-closed configuration; and FIG. 107 is a sectional view of part of a bottle with a lid formed with a teat of FIG. 96.

DETAILED DESCRIPTION OF THE EMBODIMENTS

Figure 1:
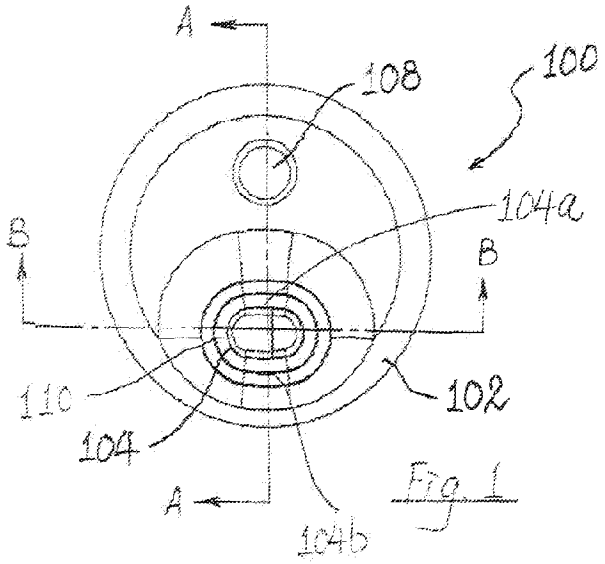
FIG. 1 is a top view of a lid, being an accessory for a drinking vessel according to a first embodiment of the present invention.
Figure 2:
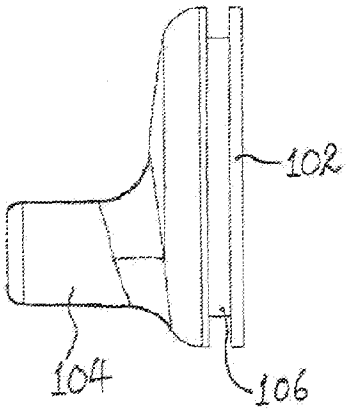
FIG. 2 is a side view of the lid shown in FIG. 1.
Figure 3:
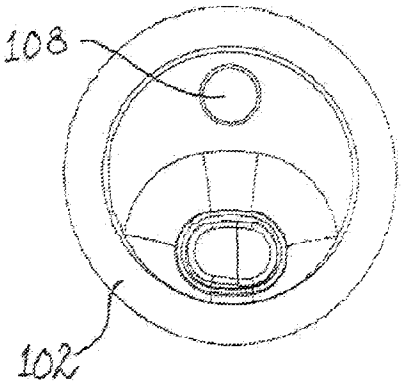
FIG. 3 is a bottom view of the lid shown in FIG. 1.
Figure 4:
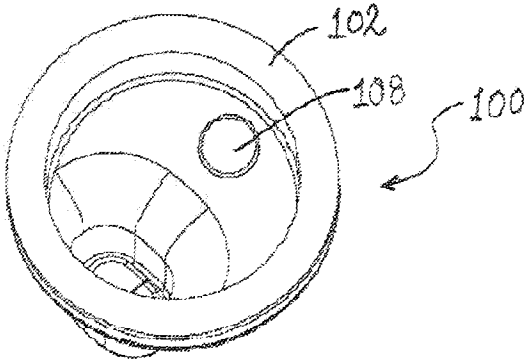
FIG. 4 is a bottom perspective view of the lid shown in FIG. 1.
Figure 5:
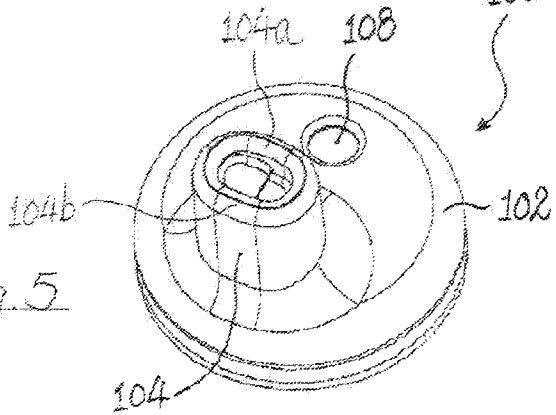
FIG. 5 is a top perspective view of the lid shown in FIG. 1.

A lid, being an accessory for a drinking vessel according to a first embodiment of this invention, is shown in FIGS. 1 to 5, and generally designated as 100.

The lid 100 has a generally flat cylindrical body 102 and a drinking spout 104 upstanding therefrom. A circular groove 106 is formed around the body 102 for releasably engaging the lid 100 with a liquid container with an open end (not shown), e.g, a cup or the like, to form a drinking vessel, which may be particularly suitable for use by toddlers. A vent hole 108 is formed through the body 102, the structure and function of which will be discussed below.

Figure 7:
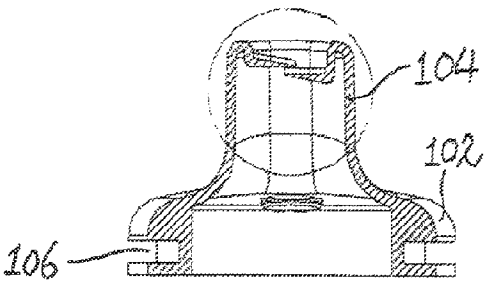
FIG. 7 is a sectional view taken along the line B-B of FIG. 1.

The spout 104 has two opposite walls 104*a*, 104*b* which are spaced apart from each other. A valve 110 is formed in the spout 104 for regulating flow of liquid through the spout 104, in particular out from the liquid container. As shown more clearly in FIGS. 7, 9 and 11, the valve 110 is made up of an upper valve membrane 110*a* and a lower valve membrane 1 lob. The upper valve membrane 110*a* has an upper surface 111*a* and an opposite lower surface 111*b*; the lower valve membrane 110*b* has an upper surface 111*c* and an opposite lower surface 111*d*. Both the upper surface 111*a* of the upper valve membrane 110*a* and the upper surface 111*c* of the lower valve membrane 110*b* face away from the interior cavity of the drinking spout 104, and both the lower surface 111*b* of the upper valve membrane 110*a* and the lower surface 111*d* of the lower valve membrane 110*b* face towards the interior cavity of the drinking spout 104. Thus, the upper surfaces 111*a*, 111*c* on the one hand and the lower surfaces 111*b*, 111*d* on the other hand face opposite directions.

Figure 6:
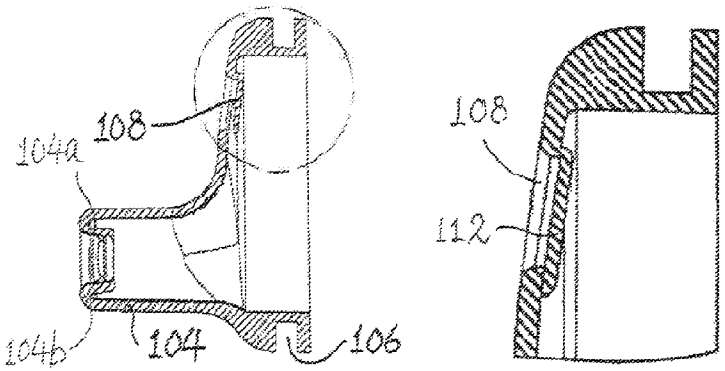
FIG. 6 is a sectional view taken along the line A-A of FIG. 1.
Figure 8:
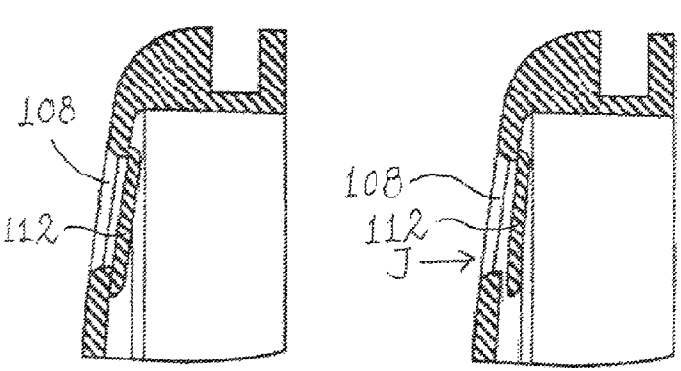
FIG. 8 is an enlarged view of the encircled part of the lid in FIG. 6 in a valve-closed scenario.
Figure 10:
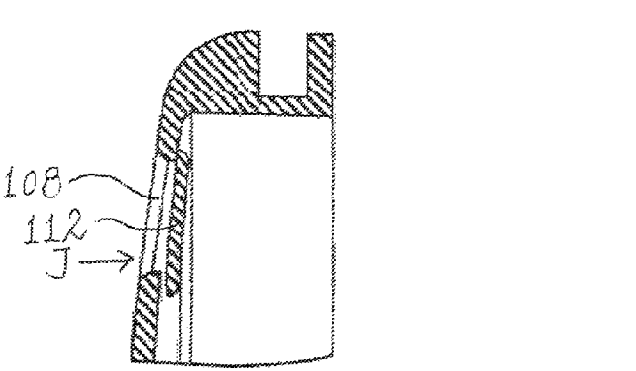
FIG. 10 is an enlarged view of the encircled part of the lid in FIG. 6 in a valve-open scenario.

Both valve membranes 110*a*, 110*b* span across the space between the two walls 104*a*, 104*b* of the spout 104, and are both integrally formed with the two walls 104*a*, 104*b* of the spout 104. As shown in FIGS. 6, 8 and 10, the vent hole 108 is provided with a deformable valve membrane 112.

The whole lid 100 (including the body 102, the spout 104, the walls 104*a*, 104*b*, and the valve membranes 110*a*, 110*b*, 112) is made integrally in one piece of a resiliently deformable plastics or rubber material, such as liquid silicone rubber.

Figure 9:
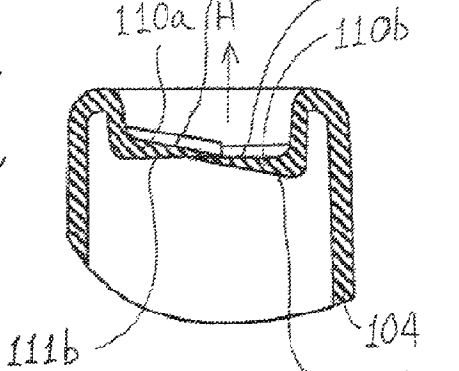
FIG. 9 is an enlarged view of the encircled part of the lid in FIG. 7 in a valve-closed scenario.

In operation, when the lid 100 is releasably fitted with the rim of an open upper end of a liquid container to form a drinking vessel, the valve membrane 112 is in the position as shown in FIG. 8 in which it contacts and overlaps part of the body 102 to close the vent hole 108. When in this normal position, both the valve membranes 110*a*, 110*b* are flat and overlap with each other to form a seal, as shown in FIG. 9. When in this sealing configuration, part of the lower surface 111*b* of the upper valve membrane 110*a* contacts and overlaps part of the upper surface 111*c* of the lower valve membrane 110*b*. If the drinking vessel is accidentally knocked down, or even turned upside down, the liquid (e.g, water, milk or fruit juice) in the liquid container will press on the lower valve membrane 110*b* to press on and against the upper valve membrane 110*a*, to better close the valve 110 to prevent egress of the liquid in the drinking vessel to the outside environment via the valve 110 of the spout 104.

Figure 11:
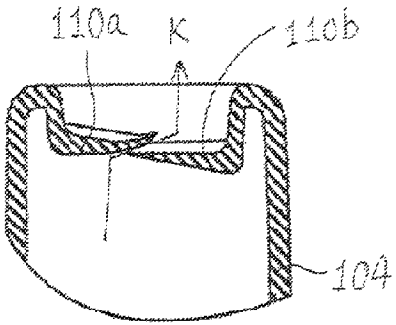
FIG. 11 is an enlarged view of the encircled part of the lid in FIG. 7 in a valve-open scenario.

When a suction force is applied through the spout 104 in the direction indicated by the arrow H in FIG. 9, e.g. by a user sucking the spout 104, the upper valve membrane 110*a* will be deformed so that it is curved and out of contact with the lower valve membrane 110*b*, as shown in FIG. 11. The valve 110 in the spout 104 is thus open, allowing the liquid in the liquid container to be drawn out from the liquid container into the mouth of the user. An advantage of the present arrangement is that the liquid, when drawn out from the liquid container via the valve 110 of the spout 104, does not exit straight through the valve 110, but has to go through a path (see the arrow K in FIG. 11) at least part which is perpendicular or at least inclined to the length of the spout 104. This effectively slows down the speed at which the liquid exits the spout 104, thus avoiding the risk of the liquid choking the user, e.g. a toddler.

When such a suction force is applied through the spout 104, the pressure in the liquid container will be reduced relative to the atmospheric pressure. The valve membrane 112 will thus be curved and moved, because of this pressure difference, to the position shown in FIG. 10 to open the vent hole 108, and air is drawn into the liquid container via the vent hole 108, as shown by the arrow J in FIG. 10.

When the user stops applying the suction force on the valve 110, in particular on the upper valve membrane 110*a*, the upper valve membrane 110*a* will return (by reason of its inherent resilience) to its un-deformed flat shape and be in contact with and overlap the lower valve membrane 110*b* again to close the valve 110. This means that the valve membrane 110*a* is biased towards this un-deformed flat shape and the position in which it is in contact with and overlaps the lower valve membrane 110*b* to close the valve 110.

The valve membrane 112 will remain in the open position to allow air from the outside environment to enter the liquid container until the air pressure in the liquid container equals to the atmospheric pressure, whereupon the valve membrane 112 will return to its original position (as shown in FIG. 8) to close the vent hole 108, to which position the valve membrane 112 is biased by reason of its resilience.

A lid, being an accessory for a drinking vessel according to a second embodiment of this invention, is shown in FIGS. 12 to 16, and generally designated as 200. Similar to the lid 100 discussed above, the lid 200 has a generally flat cylindrical body 202 and a drinking spout 204 upstanding therefrom, the drinking spout 204 forming a passageway through which a liquid may pass. The spout 204 has two walls 204*a*, 204*b* which are opposite to each other. A circular groove 206 is formed around the body 202 for releasably engaging the lid 200 with a liquid container with an open end (not shown), e.g, a cup or the like, to form a drinking vessel. A vent hole 208 is formed through the body 202.

Figure 21:
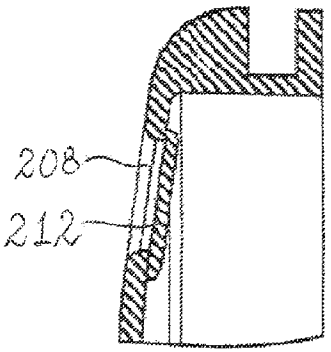
FIG. 21 is an enlarged view of the encircled part of the lid in FIG. 17 in a valve-closed scenario.
Figure 19:
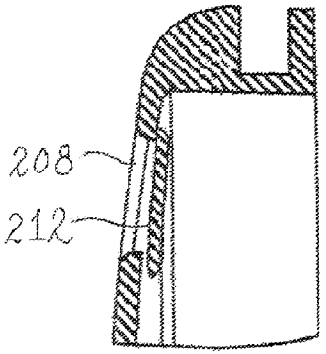
FIG. 19 is an enlarged view of the encircled part of the lid in FIG. 17 in a valve-open scenario.

The structure of the lid 200 is shown more clearly in FIGS. 17 to 22. It can be seen from FIGS. 17, 19 and 21 that the structure of the vent hole 208 is similar to that of the vent hole 108 of the lid 100. The vent hole 208 also has a valve membrane 212 which is normally in a vent-closed position in which it contacts and overlaps part of the body 202, as shown in FIG. 21, in which the valve membrane 212 closes the vent hole 208. Upon application of a suction force from the outside via the spout 204, the valve membrane 212 is curved and moved (by reason of the pressure difference) to the vent-open position, as shown in FIG. 19, in which the vent hole 208 is open, allowing air from the outside environment to enter the interior cavity of the liquid container.

Figure 14:
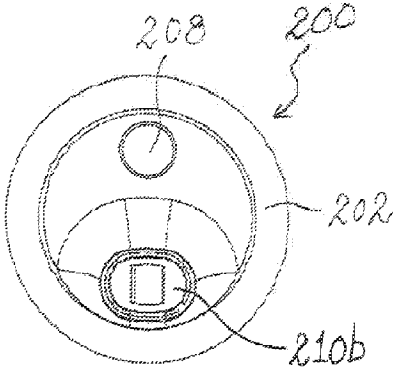
FIG. 14 is a bottom view of the lid shown in FIG. 12.
Figure 13:
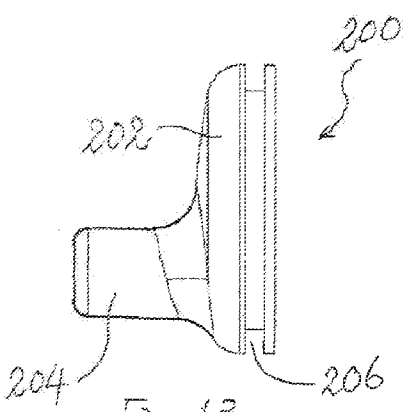
FIG. 13 is a side view of the lid shown in FIG. 12.
Figure 12:
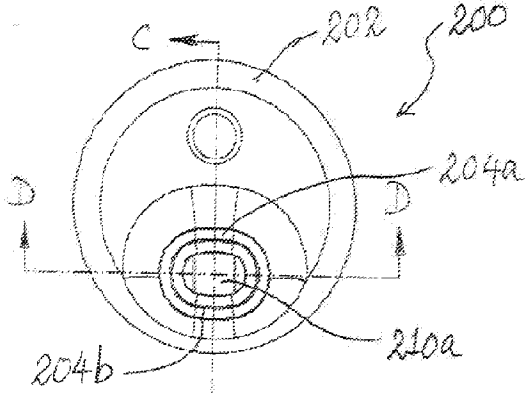
FIG. 12 is a top view of a further lid, being an accessory for a drinking vessel according to a second embodiment of the present invention.
Figure 16:
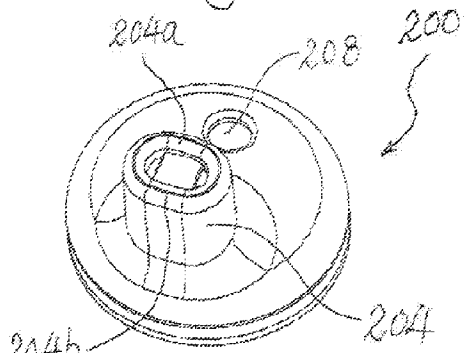
FIG. 16 is a top perspective view of the lid shown in FIG. 12.
Figure 15:
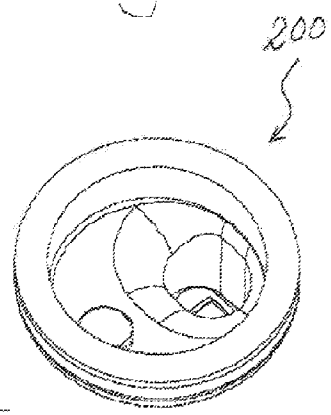
FIG. 15 is a bottom perspective view of the lid shown in FIG. 12.
Figure 22:
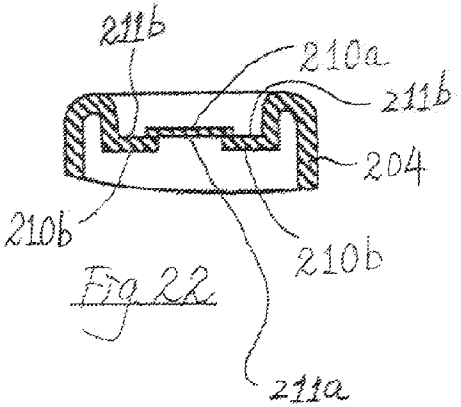
FIG. 22 is an enlarged view of the encircled part of the lid in FIG. 18 in a valve-closed scenario.
Figure 20:
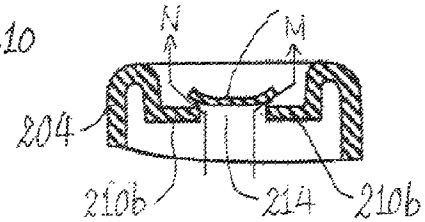
FIG. 20 is an enlarged view of the encircled part of the lid in FIG. 18 in a valve-open scenario.
Figure 17:
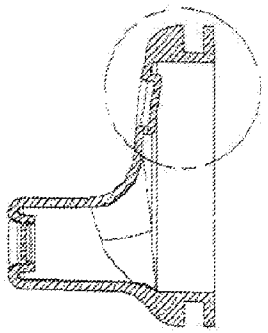
FIG. 17 is a sectional view taken along the line C-C of FIG. 12.
Figure 18:
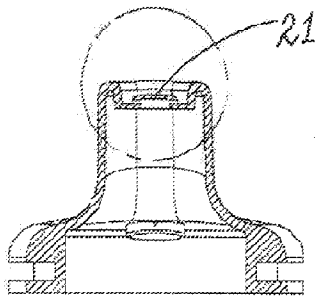
FIG. 18 is a sectional view taken along the line D-D of FIG. 12.

A main difference between the lid 200 and the lid 100 resides in the structure of a valve 210 in the spout 204. As can be seen in FIGS. 18, 20 and 22, the valve 210 has an upper valve membrane 210*a* and a lower valve membrane 210*b*. The upper valve membrane 210*a* is elongate in shape and spans across the space between the two walls 204*a*, 204*b* of the spout 204. The longitudinal ends of the valve membrane 210*a* are integrally formed with the two walls 204*a*, 204*b* of the spout 204. As can be seen in FIGS. 14 and 20, the lower valve membrane 210*b* is integrally formed all-round with the inner surface of the spout 204 and is provided with a generally rectangular hole 214. The upper valve membrane 210*a* is wider than the width of the hole 214.

When in the normal position as shown in FIG. 22, the upper valve membrane 210*a* is flat, and contacts and overlaps partly with the lower valve membrane 210*b*, and closes the hole 214. In this valve-closed configuration, part of a lower surface 211*a* of the upper valve membrane 210*a* contacts and overlaps with past of an upper surface 211*b* of the lower valve membrane 210*b*.

When a suction force is applied on the valve 210 of the spout 204, the upper valve membrane 210*a* will be deformed into a curved shape in which it is out of contact with the lower valve membrane 210*b*, whereby the hole 214 is open. In such a valve-open configuration, liquid (e.g. water or milk) in the liquid container will be drawn by the suction force out of the liquid container through two gaps between the upper valve membrane 210*a* and the lower valve membrane 210*b*. As in the case of the lid 100 discussed above, an advantage of the lid 200 is that the liquid, when drawn out from the liquid container via the valve 210 of the spout 204, does not exit straight through the valve 210, but has to go through one of two paths (see the arrows M and N in FIG. 20), in which at least part of each path is perpendicular or at least inclined to the length of the spout 204. This effectively slows down the speed at which the liquid exits the spout 204, thus avoiding the risk of the liquid choking the user, e.g, a toddler.

A lid, being an accessory for a drinking vessel according to a third embodiment of this invention, is shown in FIGS. 23 to 27, and generally designated as 300. Similar to the lid 100 discussed above, the lid 300 has a generally flat cylindrical body 302 and a drinking spout 304 extending therefrom, the spout 304 serving as a passageway through which a liquid may pass. The spout 304 has two walls 304*a*, 304*b* which are opposite to each other. A groove 306 is formed around the body 302 for releasably engaging the lid 300 with a liquid container with an open end (not shown), e.g, a cup or the like, to form a drinking vessel. A closable vent hole 308 is formed through the body 302 for allowing air to pass from the outside environment to the inside cavity of the drinking vessel.

Figure 25:
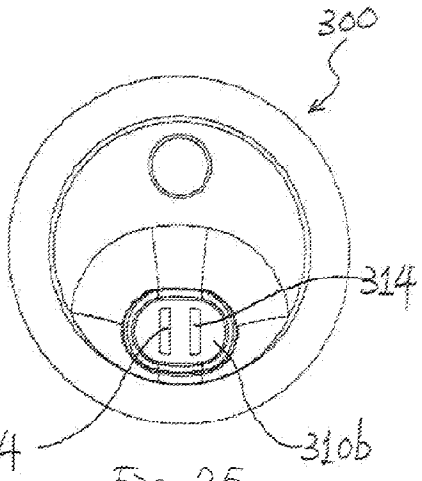
FIG. 25 is a bottom view of the lid shown in FIG. 23.
Figure 24:
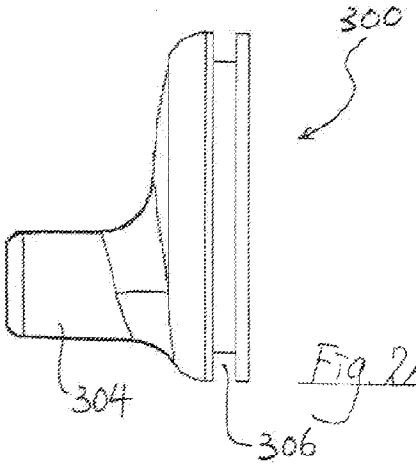
FIG. 24 is a side view of the lid shown in FIG. 23.
Figure 23:
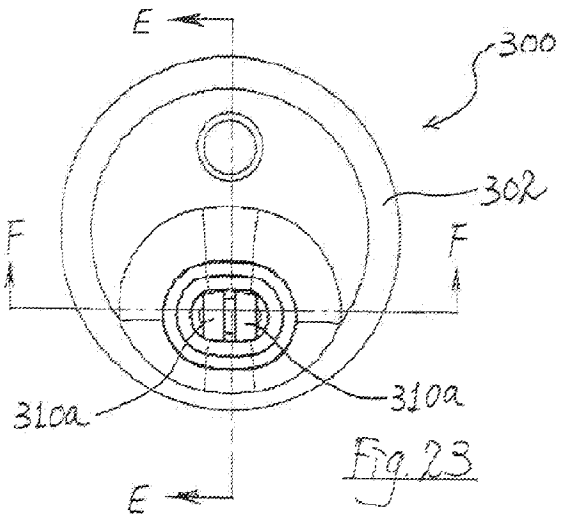
FIG. 23 is a top view of a further lid, being an accessory for a drinking vessel according to a third embodiment of the present invention.
Figure 27:
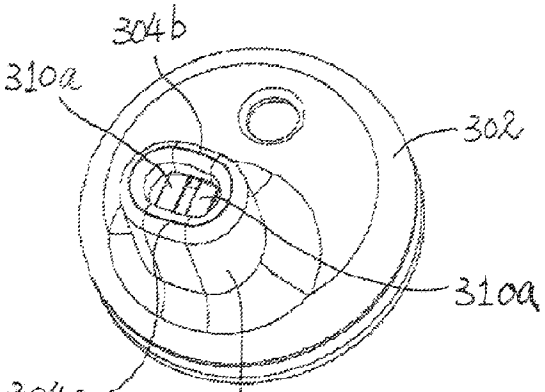
FIG. 27 is a top perspective view of the lid shown in FIG. 23.
Figure 26:
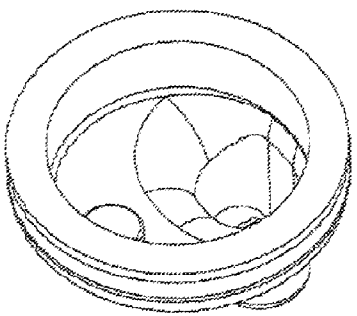
FIG. 26 is a bottom perspective view of the lid shown in FIG. 23.
Figure 32:
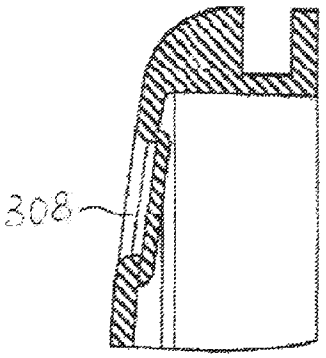
FIG. 32 is an enlarged view of the encircled part of the lid in FIG. 28 in a valve-closed scenario.
Figure 33:
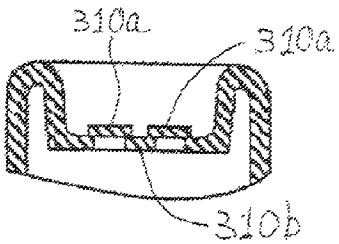
FIG. 33 is an enlarged view of the encircled part of the lid in FIG. 29 in a valve-closed scenario.
Figure 30:
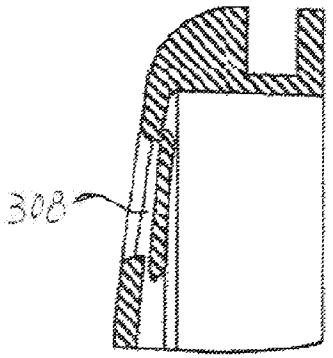
FIG. 30 is an enlarged view of the encircled part of the lid in FIG. 28 in a valve-open scenario.
Figure 31:
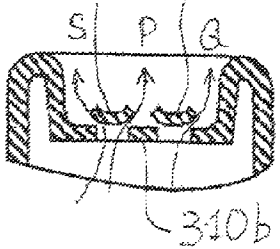
FIG. 31 is an enlarged view of the encircled part of the lid in FIG. 29 in a valve-open scenario.
Figure 28:
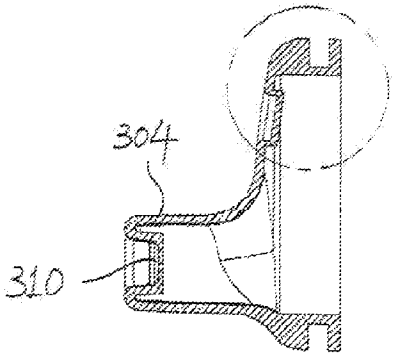
FIG. 28 is a sectional view taken along the line E-E of FIG. 23.
Figure 29:
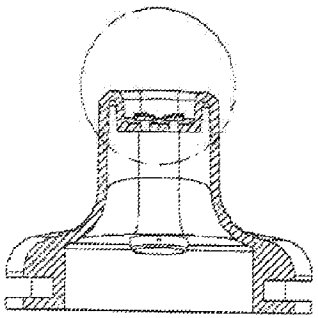
FIG. 29 is a sectional view taken along the line F-F of FIG. 23.

A main difference between the lid 300 and the lid 100 resides in the structure of a valve 310 in the spout 304. As can be seen in FIGS. 29, 31 and 33, the valve 310 has two elongate upper valve membranes 310*a* and a lower valve membrane 310*b*. The valve membranes 310*a* span across the space between the two walls 304*a*, 304*b* of the spout 304, and longitudinal ends of the valve membranes 310*a* are integrally formed with the two walls 304*a*, 304*b* of the spout 304. As can be seen in FIGS. 25, 31 and 33, the lower valve membrane 310*b* is integrally formed all-round with the inner surface of the spout 304 and is provided with two generally rectangular holes 314. Each of the upper valve membranes 310*a* is wider than the width of the respective hole 314.

When in the normal position as shown in FIG. 33, the upper valve membranes 310*a* are flat, contact and overlap partly with the lower valve membrane 310*b*, and close the holes 314. In particular, in such a valve-closed configuration, parts of the lower surfaces of the upper valve membranes 310*a* contact and overlap with part of the upper surface of the lower valve membrane 310*b*.

When a suction force is applied through the spout 304, each of the upper valve membranes 310*a* will be deformed into a curved shape in which it is out of contact with the lower valve membrane 310*b*. In such a valve-open configuration, the holes 314 are open, and liquid (e.g, water or milk) in the liquid container will be drawn by the suction force out of the liquid container through a plurality of gaps between the upper valve membranes 310*a* and the lower valve membrane 310*b*. As in the case of the lid 100 discussed above, an advantage of the lid 300 is that the liquid, when drawn out from the liquid container via the valve 310 of the spout 304, does not exit straight through the valve 310, but has to go through one of several paths (see the arrows P, Q and S in FIG. 31), in which at least part of each path is perpendicular or at least inclined to the length of the spout 304. This effectively slows down the speed at which the liquid exits the spout 304.

Comparing the lids 100, 200 and 300, it can be seen that there is one gap through which liquid may exit the lid 100, there are two gaps through which liquid may exit the lid 200, and there are three gaps through which liquid may exit the lid 300. This means that if a same suction force is applied on the spout 104, 204 and 304, more liquid will be drawn out via the spout 304 than via the spout 204, and more liquid will be drawn out via the spout 204 than via the spout 104. Generally speaking, the more the number of gaps is, the higher the flow rate is under the same suction force applied on the spout.

Figure 35:
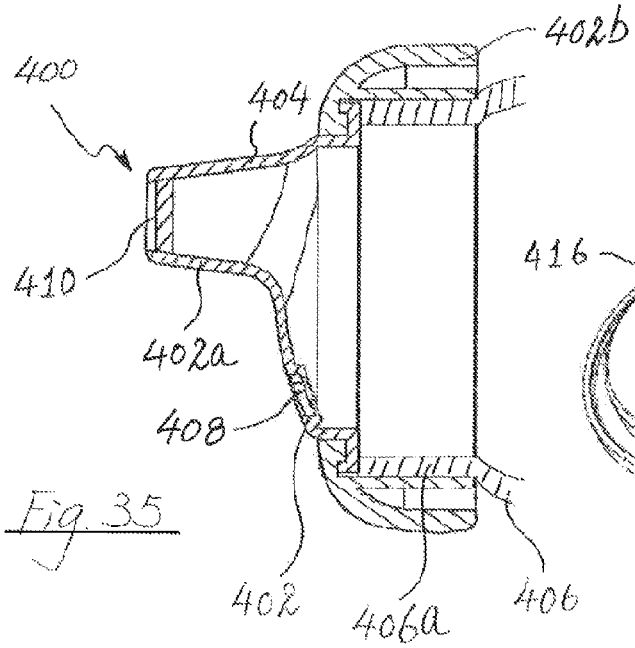
FIG. 35 is a sectional view of the lid in FIG. 34, shown as engaged with an open upper end of a bottle.
Figure 34:
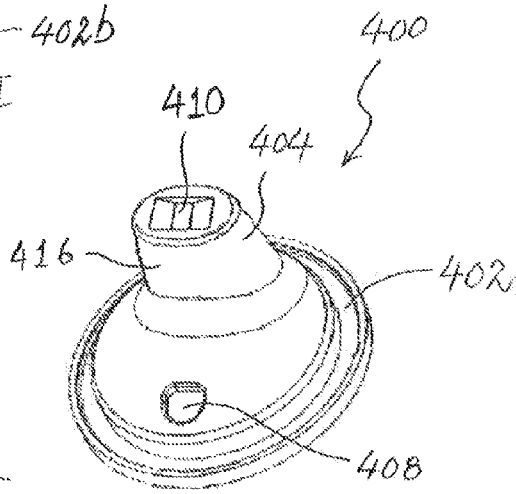
FIG. 34 is a perspective view of a yet further lid, being an accessory for a drinking vessel according to a fourth embodiment of the present invention.

A lid, being an accessory for a drinking vessel according to a fourth embodiment of this invention, is shown in FIGS. 34 and 35, and generally designated as 400. As shown more clearly in FIG. 35, the lid 400 has a body 402 which is made up of two body parts 402*a*, 402*b* which are engaged with each other, e.g. by force fitting, snap fitting, etc. The body part 402*a* is made of a material which is softer than that of which the body part 402*b* is made. For example, the body part 402*a* may be made of liquid silicone rubber; and the body part 402*b* may be made of polypropylene (PP). The body part 402*b* has an internal thread for releasable threaded engagement with an external thread of an open upper end 406*a* of a bottle 406 to form a drinking vessel. When a drinking vessel is so assembled, a seal is formed between the bottom of the lid 400 and the rim of the upper open end 406*a* of the bottle 406.

Figure 36:
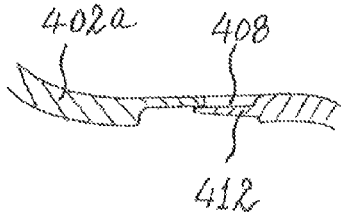
FIG. 36 is a sectional view of the vent hole of the lid in FIG. 34 in a closed configuration.
Figure 37:
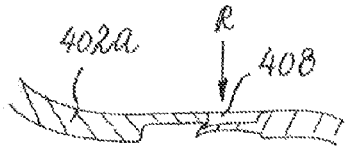
FIG. 37 is a sectional view of the vent hole of the lid in FIG. 34 in an open configuration.
Figure 40:
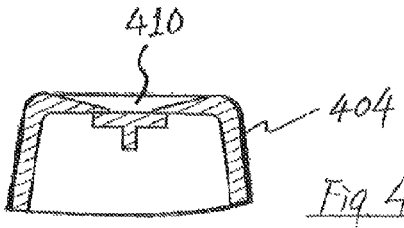
FIG. 40 is an enlarged sectional view of an alternative spout of the lid in FIG. 34 in a valve-closed configuration.

The body part 402*a* is formed with a vent hole 408, the structure and manner of operation of which are shown more clearly in FIGS. 36 and 37. As shown in FIG. 36, a valve membrane 412 is normally in contact with and overlaps the body 402*a*, to close the vent hole 408. The valve membrane 412 is biased, by virtue of its own inherent resilience, to this vent-closed configuration. When the interior of the drinking vessel is at a lower pressure than the atmospheric pressure, e.g. when a suction force is applied through a spout 404 (see FIG. 35 and to be discussed below), the atmospheric pressure exerts a pressure on the valve membrane 412 in the direction indicated by the arrow R in FIG. 37, which causes the valve membrane 412 to deform from its vent-closed configuration to the configuration as shown in FIG. 37 (called the "vent-open configuration"), in which the vent hole 408 is open (in which the membrane 412 is out of contact with the body 402*a*), thus allowing air from the outside environment to enter the interior of the drinking vessel via the vent hole 408.

Figure 38:
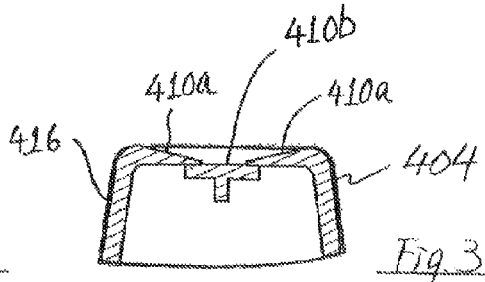
FIG. 38 is an enlarged sectional view of the spout of the lid in FIG. 34 in a valve-closed configuration.
Figure 39:
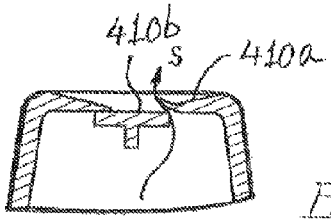
FIG. 39 is an enlarged sectional view of the spout in FIG. 38 in a valve-open configuration.
Figure 43:
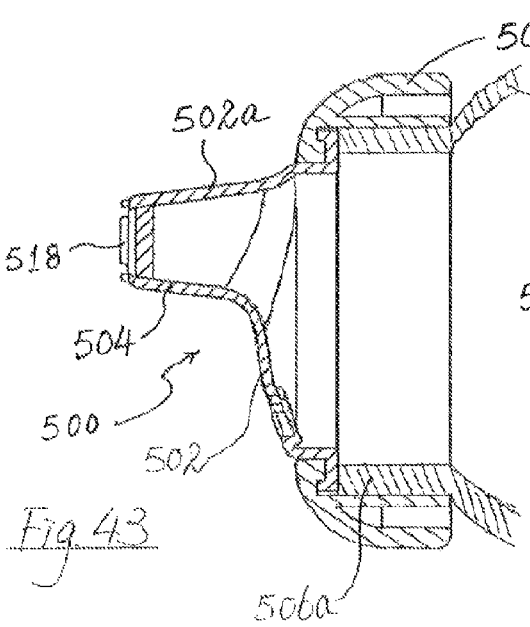
FIG. 43 is a sectional view of the lid in FIG. 42, shown as engaged with an open upper end of a bottle.
Figure 42:
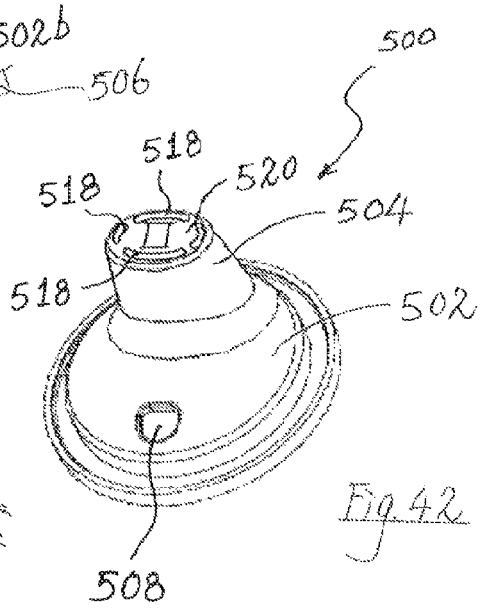
FIG. 42 is a perspective view of a still further lid, being an accessory for a drinking vessel according to a fifth embodiment of the present invention; configuration.
Figure 44:
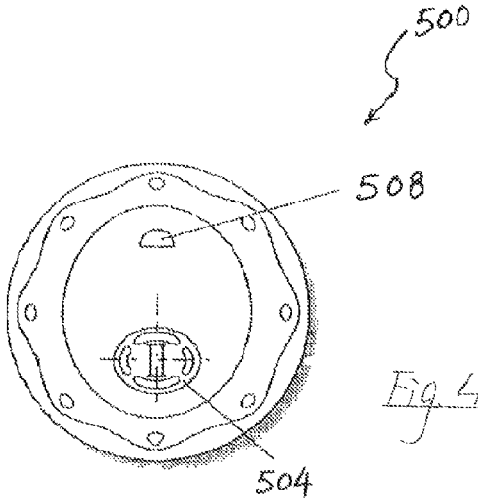
FIG. 44 is a top view of the lid in FIG. 42.

Returning to FIG. 35, the first body part 402*a* is also integrally formed with a spout 404 with an upstanding wall 416. As shown more clearly in FIG. 38, the spout 404 is formed with a valve 410 with two upper valve membranes 410*a* and one lower valve membrane 410*b*, in which at least part of each upper valve membrane 410*a* overlaps at least part of the lower membrane 410*b*. Each of the upper valve membranes 410*a* and the lower valve membrane 410*b* is integrally formed with two opposite walls of the spout 404. When the body part 402*a* is originally formed, the upper valve membranes 410*a* and the lower membrane 410*b* are fixed and connected with one another. One may then cut open the connection between one of the upper valve membranes 410*a* and the lower membrane 410*b*, so as to make only one of the upper valve membranes 410*a* deformable (see FIG. 39) to form a gap allowing the content in the drinking vessel formed by the lid 400 and a container (not shown) to be sucked out through the gap along the path shown by the arrow S in FIG. 39.

Figure 41:
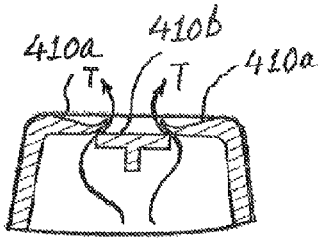
FIG. 41 is an enlarged sectional view of the spout in FIG. 40 in a valve-open configuration.

If it is desired to allow the content in the drinking vessel to be drawn out through the spout 404 at a higher flow rate, one may cut open both connections between the upper valve membranes 410*a* and the lower valve membrane 410*b* in such a way that they are in contact with and overlap with each other to form an openable valve, thus allowing both upper valve membranes 410*a* to deform (see FIG. 41) upon application of a suction force. Two gaps are thus formed between the upper valve membranes 410*a* and the lower valve membrane 410*b* when a suction force is applied on the spout 404, allowing the content in the drinking vessel formed by the lid 400 and a container (not shown) to be sucked out through the gaps along the paths shown by the arrows T in FIG. 41.

To facilitate deformation of the upper valve membranes 410*a*, the upper valve membranes 410*a* are formed such that they taper from where they join the spout wall 416 towards where a lower surface of the upper membranes 410*a* contact and overlap an upper surface of the lower valve membrane 410*b*, i.e. for each upper valve membrane 410*a*, where it joins the spout wall 416 is thicker than where it contacts and overlaps the lower valve membrane 410*b*.

A lid, being an accessory for a drinking vessel according to a fifth embodiment of this invention, is shown in FIGS. 42 to 46, and generally designated as 500. This lid 500 is structurally very similar to the lid 400 discussed above. As in the case of the lid 400, the lid 500 also has a body 502 formed of two body parts 502*a*, 502*b* engaged with each other. The body part 502*a* may be made of liquid silicone rubber and the body part 502*b* may be made of polypropylene. A spout 504 and a vent hole 508 are formed on the body part 502. The body part 502*b* is also formed with an internal thread for releasable threaded engagement with an external thread at an open upper end 506*a* of a liquid container in the form of a bottle 506, to form a drinking vessel. When the drinking vessel is so assembled, the bottom of the lid 500 is in contact with the rim of the upper open 506*a* end of the bottle 506 to form a seal.

Figure 49:
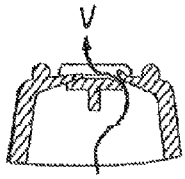
FIG. 49 is an enlarged sectional view of the spout in FIG. 48 in a valve-open configuration.
Figure 52:
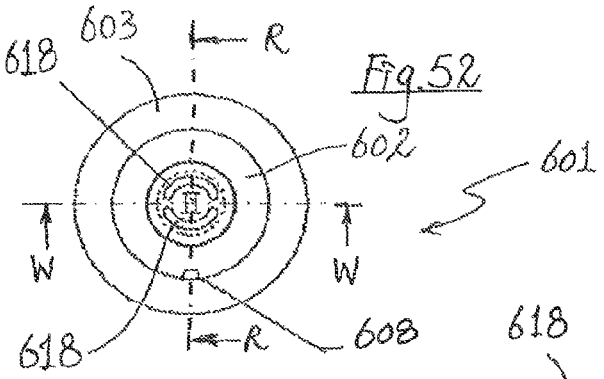
FIG. 52 is a top view of a teat for forming a lid, being an accessory for a drinking vessel according to a sixth embodiment of the present invention.

As in the case of the lid 400 discussed above, and as shown in FIGS. 48 to 51, the spout 504 formed on and extending from the top surface of the lid 500 is formed with a valve 510 with two upper valve membranes 510*a* and a lower valve membrane 510*b*. When the body part 502*a* is originally formed, the upper valve membranes 510*a* and the lower membrane 510*b* are integrally connected with one another. One may then cut open the connection between one of the upper valve membranes 510*a* and the lower membrane 510*b* in such a way that part of the lower surface of the upper valve membrane 510*a* contacts with and overlaps with part of an upper surface of the lower valve membrane 510*b* to form an openable valve, so as to allow only one of the upper valve membranes 510*a* to deform (see FIG. 49) upon application of a suction force, thus forming a gap allowing the content in the drinking vessel formed by the lid 500 and a container (not shown) to be sucked out through the gap along the path shown by the arrow V in FIG. 49.

If it is desired to allow the content in the drinking vessel to be drawn out through the spout 504 at a higher flow rate, one may cut open both connections between the upper valve membranes 510*a* and the lower valve membrane 510*b*, thus allowing both upper valve membranes 510*a* to deform (see FIG. 51) upon application of a suction force. Two gaps are thus formed between the upper valve membranes 510*a* and the lower valve membrane 510*b*, allowing the content in the drinking vessel formed by the lid 500 and a container (not shown) to be sucked out through the gaps along the paths shown by the arrows Y in FIG. 51.

Figure 47:
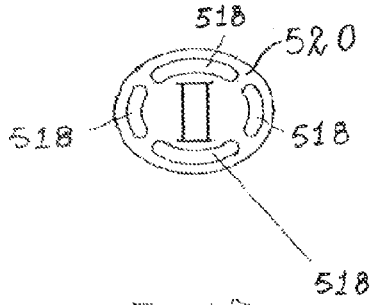
FIG. 47 is an enlarged top view of the spout of the lid in FIG. 44.
Figure 45:
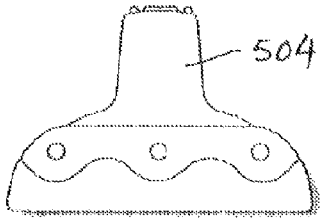
FIG. 45 is a front view of the lid in FIG. 44.
Figure 46:
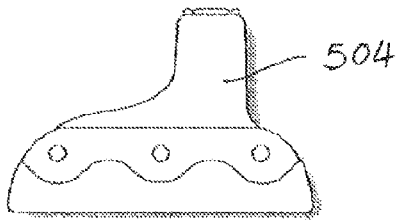
FIG. 46 is a side view of the lid in FIG. 44.
Figure 50:
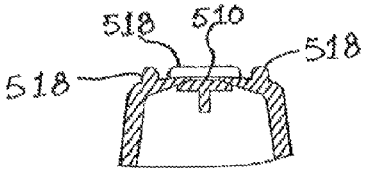
FIG. 50 is an enlarged sectional view of an alternative spout of the lid in FIG. 42 in a valve-closed configuration.
Figure 48:
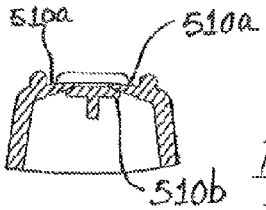
FIG. 48 is an enlarged sectional view of the spout of the lid in FIG. 42 in a valve-closed configuration.
Figure 51:
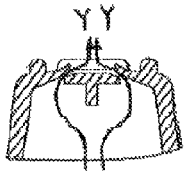
FIG. 51 is an enlarged sectional view of the spout in FIG. 50 in a valve-open configuration.

A major difference between the lid 500 and the lid 400 is that, in the lid 500, and as shown more clearly in FIG. 47, four ribs 518 protruding from an upper surface 520 of the spout 504 are formed integrally with the spout 504, for reinforcement purposes and for protection of the valve 510.

Figure 53:
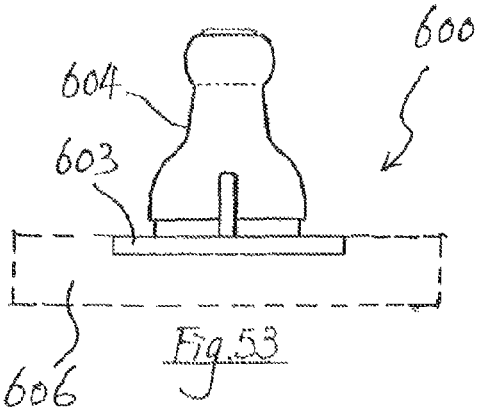
FIG. 53 is a front view of the teat of FIG. 52.
Figure 54:
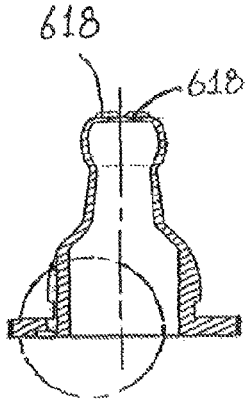
FIG. 54 is a sectional view taken along the line R-R of FIG. 52.
Figure 55:
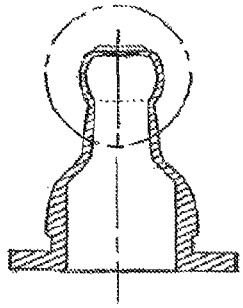
FIG. 55 is a sectional view taken along the line W-W of FIG. 52.
Figure 56:
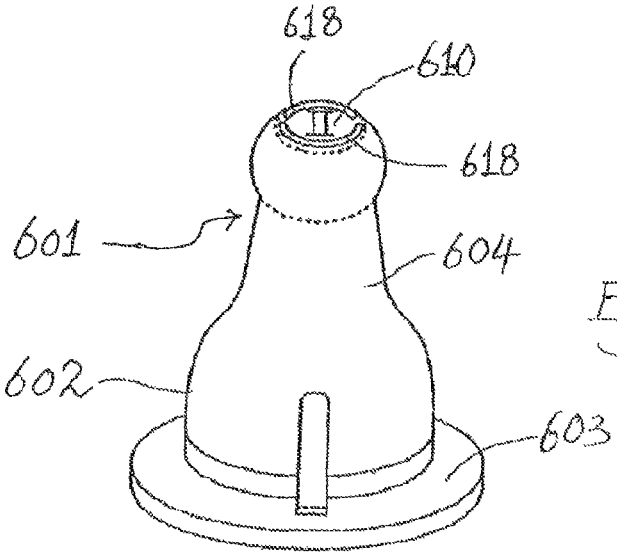
FIG. 56 is a perspective view of the teat of FIG. 52.

FIGS. 52 to 56 show a teat (also called a "nipple"), generally designated as 601, for forming a lid according to a sixth embodiment of the present invention, generally designated as 600 in FIG. 53. This teat 601 has a body 602 made in one piece of silicone or rubber like plastic material. The body 602 of the teat 601 has a generally planar circular base 603 and a spout 604 extending therefrom. As shown in FIG. 53, the teat 601 is releasably engaged with a generally cylindrical cover 606 (shown in dotted lines in FIG. 53) to form the lid 600. The lid 600 may be threadedly engaged with a bottle (not shown) to form a spilled-proof bottle suitable for use by babies or toddlers.

Figure 59:
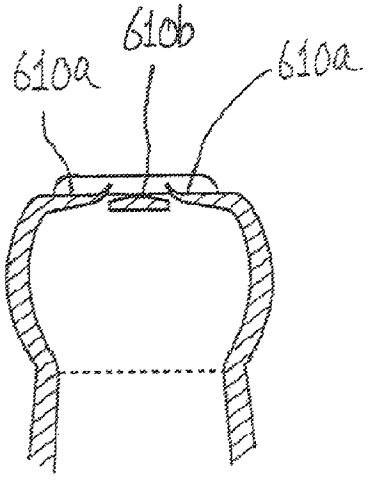
FIG. 59 is an enlarged view of the encircled part in FIG. 55 in a second valve-open configuration.
Figure 58:
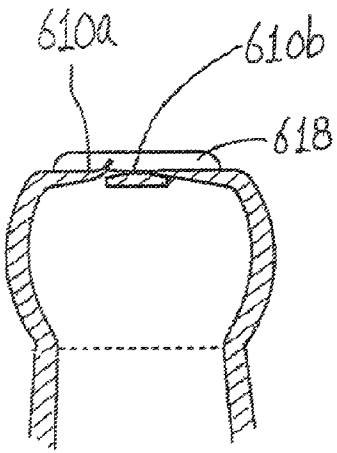
FIG. 58 is an enlarged view of the encircled part in FIG. 55 in a first valve-open configuration.
Figure 57:
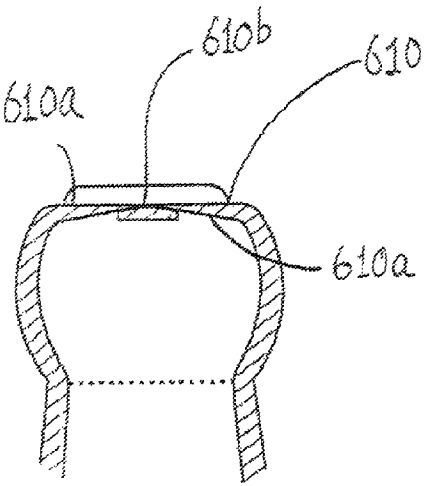
FIG. 57 is an enlarged view of the encircled part in FIG. 55 in a valve-closed configuration.

At the top of the spout 604 is formed a valve 610 the structure of which is shown more clearly in FIGS. 57 to 59. As can be seen in FIGS. 57 to 59, the valve 610 has two upper valve membranes 610*a* and one lower valve membrane 610*b*. Each of the upper valve membranes 610*a* and lower valve membrane 610*b* has two ends which are fixed with and integrally formed with two opposite walls of the spout 604. When the teat 601 is originally formed, the upper valve membranes 610*a* and the lower membrane 610*b* are integrally connected with one another. One may then cut open the connection between one of the upper valve membranes 610*a* and the lower valve membrane 610*b* in such a way that part of a lower surface of the upper valve membrane 610 contacts and overlaps with part of an upper surface of the lower valve membrane 610*b* to form an openable valve. When the lid 600 is engaged with a container, e.g. a bottle, to form a drinking vessel, upon application of a suction force through the valve 610 of the spout 604, only one upper valve membrane 610*a* deforms and moves away and out of contact from the lower valve membrane 610*b* (see FIG. 58), thus forming a gap allowing the content in the drinking vessel to be sucked out through the gap between the deformed upper valve membrane 610*a* and the lower valve membrane 610*b*.

If it is desired to allow the content in the drinking vessel to be drawn out through the spout 604 at a higher flow rate, one may cut open both connections between the upper valve membranes 610*a* and the lower valve membrane 610*b*, thus allowing both upper valve membranes 610*a* to deform and move away and out of contact from the lower valve membrane 610*b* (see FIG. 59) upon application of a suction force, in which case two gaps are formed allowing the content in the drinking vessel to be sucked out through the gaps between the deformed upper valve membranes 610*a* and the lower valve membrane 610*b*.

To strengthen the structure of the spout 604, two curved ribs 618 are formed on top of the spout 604 around the valve 610.

Figure 60:
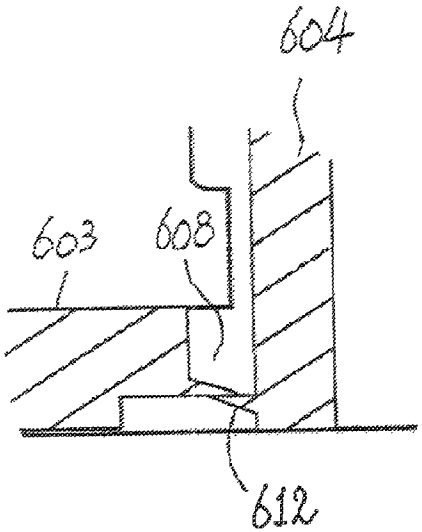
FIG. 60 is an enlarged view of the encircled part in FIG. 54 in a valve-closed configuration.
Figure 61:
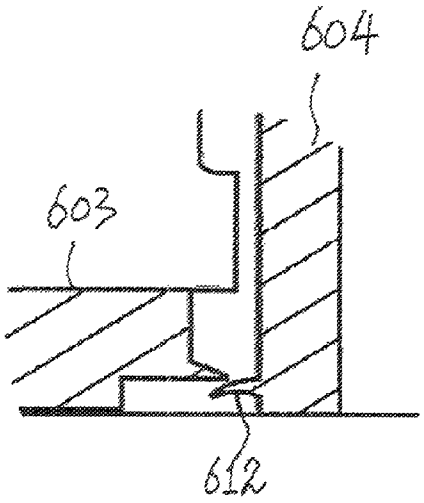
FIG. 61 is an enlarged view of the encircled part in FIG. 54 in a valve-open configuration.
Figure 62:
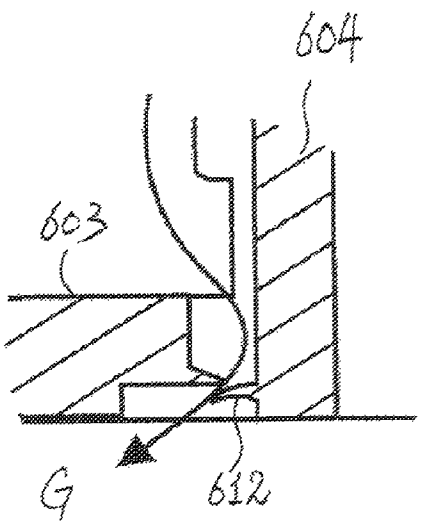
FIG. 62 is an enlarged view of the encircled part in FIG. 54 in a valve-open configuration, showing the direction of movement of air therethrough.

A vent hole 608 is formed through the base 603 of the body 602 of the teat 601, as shown clearly in FIGS. 60 to 62. The vent hole 608 has a valve membrane 612 which is movable between a vent-closed position as shown in FIG. 60 in which it closes the vent 608 by contacting and overlapping the base 603 of the body 602 and a vent-open position as shown in FIGS. 61 and 62 in which the valve membrane 612 is out of contact with, and does not overlap, the base 603.

When the lid 600 incorporated with the teat 601 is assembled with a bottle to form a drinking vessel, and during operation of the lid 600 in which a suction force is applied through the spout 604, the internal air pressure in the drinking vessel is reduced. Because of the difference between the internal air pressure in the drinking vessel and the atmospheric pressure, the valve membrane 612 will be deformed and moved from its vent-closed position as shown in FIG. 60 to the vent-open position as shown in FIG. 61, allowing air from the atmosphere to enter the interior of the drinking vessel, in the direction indicated by the arrow G in FIG. 62. When the suction force is removed, and when the internal air pressure in the drinking vessel is allowed to return to the atmospheric pressure, the valve membrane 612 will return to the vent-closed position as shown in FIG. 60, to which it is biased by reason of its own resilience.

Figure 63:
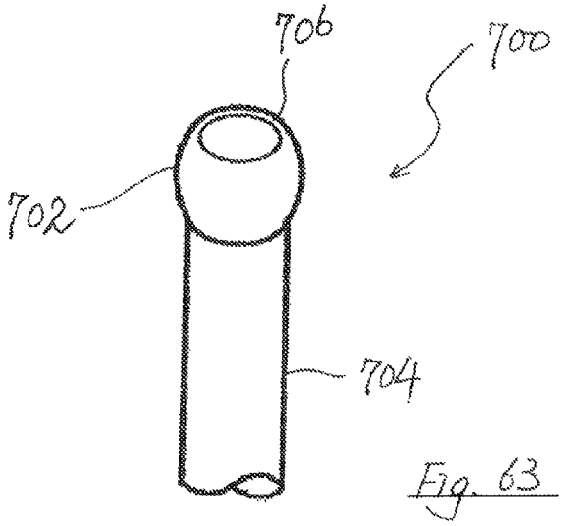
FIG. 63 is a perspective view of a straw, being an accessory for a drinking vessel according to a seventh embodiment of the present invention.
Figure 64:
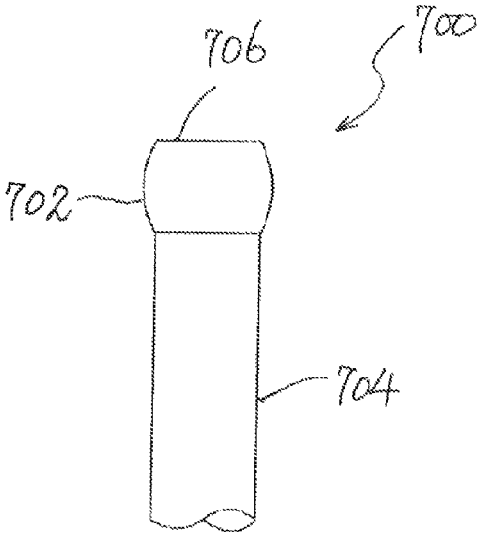
FIG. 64 is a front view of the straw of FIG. 63.
Figure 65:
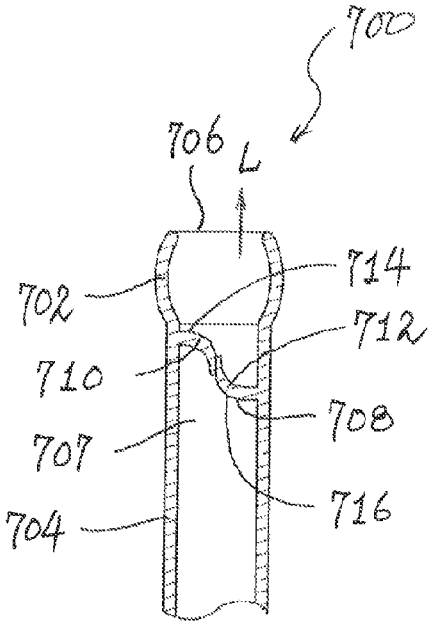
FIG. 65 is a longitudinal sectional view of the straw of FIG. 64.
Figure 66:
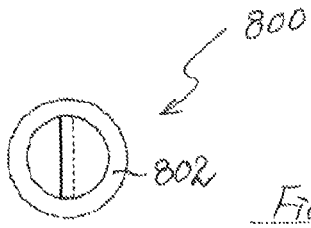
FIG. 66 is a top view of a straw, being an accessory for a drinking vessel according to an eighth embodiment of the present invention.
Figure 67:
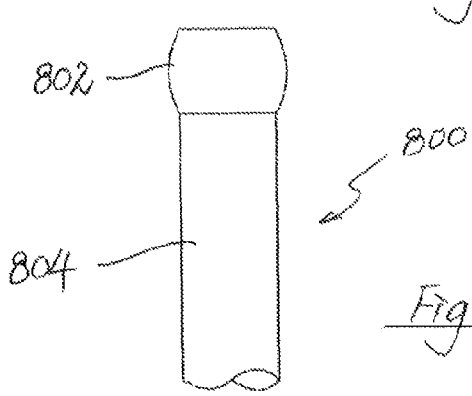
FIG. 67 is a front view of the straw of FIG. 66.
Figure 68:
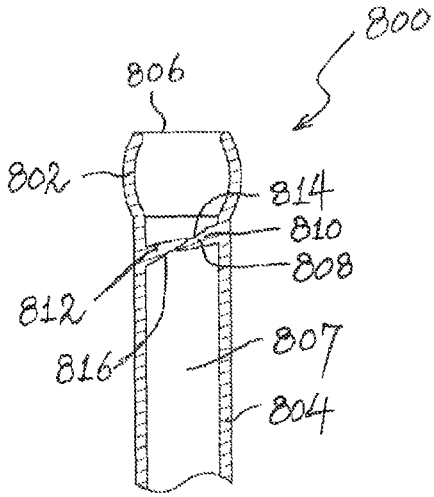
FIG. 68 is a longitudinal sectional view of the straw of FIG. 67 in a valve-closed configuration.
Figure 69:
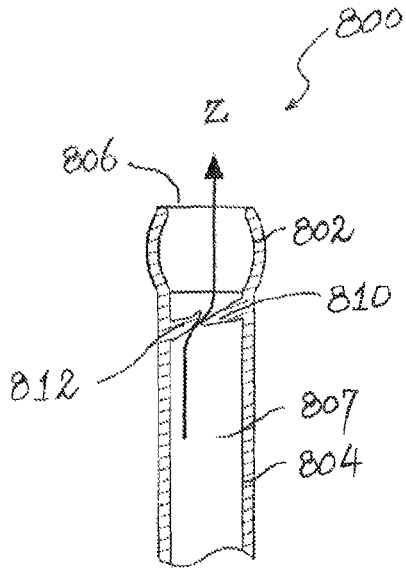
FIG. 69 is a longitudinal sectional view of the straw of FIG. 67 in a valve-open configuration.
Figure 70:
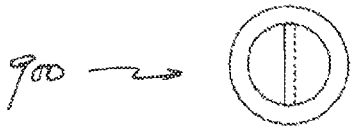
FIG. 70 is a top view of a straw, being an accessory for a drinking vessel according to a ninth embodiment of the present invention.
Figure 71:
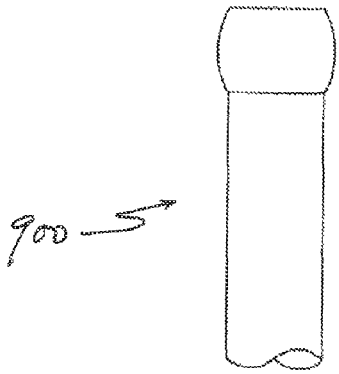
FIG. 71 is a front view of the straw of FIG. 70.
Figure 72:
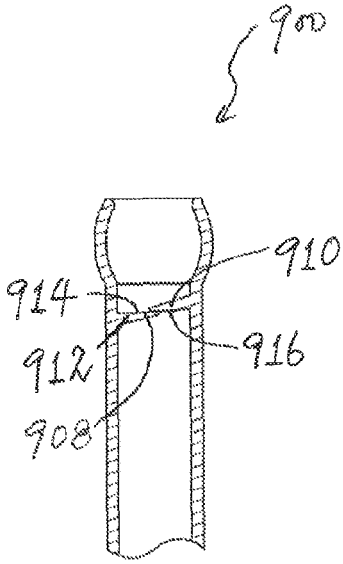
FIG. 72 is a longitudinal sectional view of the straw of FIG. 71 in a valve-closed configuration.
Figure 73:
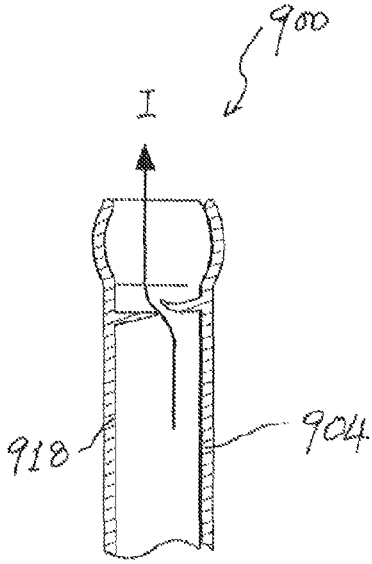
FIG. 73 is a longitudinal sectional view of the straw of FIG. 71 in a valve-open configuration.

A straw, being an accessory for a drinking vessel according to a seventh embodiment of the present invention, is shown in FIGS. 63 to 65, and generally designated as 700. When a baby reaches one year old, it can use a straw on cup or beaker, and a non-spill straw is a good choice for the baby transiting from using nipple/spout to a soft straw.

The straw 700 has a part-spherical head 702 which is integrally joined with an elongate cylindrical body 704. A central longitudinal passageway 707 runs through the body 704 and the head 702. The passageway 707 allows air or liquid to pass from a longitudinal free end of the body 704 through the passageway 707 to an opposite longitudinal free end 706 of the head 702.

Disposed within the passageway 707 in the body 704 is a valve 708 including an upper valve membrane 710 and a lower valve membrane 712 which are integrally formed with the inner wall of the passageway 707 of the body 704 at tilted angle, for easy production. Each of the upper valve membrane 710 and the lower valve membrane 712 has an upper surface which faces towards the head 702 and an opposite lower surface which faces towards the free end of the body 704. When the valve 708 is in a valve-closed configuration, as shown in FIG. 65, a part of an upper surface 714 of the upper valve membrane 710 contacts and overlaps with a part of a lower surface 716 of the lower valve membrane 712. Both the upper valve membrane 710 and the lower valve membrane 712 are biased, by reason of their own resilience, to the position as shown in FIG. 65, which means that the valve 708 is biased to the vent-closed configuration. When in this vent-closed configuration, the part of the upper surface 714 of the upper valve membrane 710 and the part of the lower surface 716 of the lower valve membrane 712 which contact and overlap with each other are parallel to the length of the body 704.

Upon application of a suction force on the free end 706 of the head 702 in the direction indicated by the arrow L, the lower valve membrane 712 will be caused to deform to move away from and out of contact with the upper valve membrane 710, so as to open the valve 708, to allow liquid to pass from the body 704 through the valve 708 to the head 702, to be consumed by a user. When the suction force is ceased to be applied on the valve 708, the valve membrane 712 will return to its normal position to close the valve 708. It can thus be seen that if the straw 700 is inserted through a hole of a cap or lid engaged with an open end of a liquid container, even if the liquid container is accidentally knocked over, provided that the lid is not disengaged from the liquid container and no liquid escapes from between the lid and the liquid container, no liquid can escape through the straw 700 to the outside environment.

A straw, being an accessory for a drinking vessel according to an eighth embodiment of the present invention, is shown in FIGS. 66 to 69, and generally designated as 800. As in the case of the straw 700 discussed above, the straw 800 also has a past-spherical head 802 joined and integrally formed with an elongate cylindrical body 804. A central longitudinal passageway 807 runs through the body 804 and the head 802. The passageway 807 allows air or liquid to pass from a free end of the body 804 through the passageway 807 to a free end 806 of the head 802.

A valve 808 is provided in the body 804 of the straw 800, which valve 808 including an upper valve membrane 810 and a lower valve membrane 812. When in the valve-closed configuration, part of an upper surface 814 of the upper valve membrane 810 contacts and overlaps part of a lower surface 816 of the lower valve membrane 812 to close the valve 808. Upon application of a suction force in the direction indicated by the arrow Z in FIG. 69, the lower valve membrane 812 will deform and be moved away from the upper valve membrane 810 to open the valve 808, thus allowing air or liquid to pass through the valve 818.

Both the upper valve membrane 810 and lower valve membrane 812 are formed integrally with a circular wall 818 of the body 804. It can also be seen from FIG. 66 that both the upper valve membrane 810 and lower valve membrane 812 are joined and integral with opposite sides of the wall 818.

A straw, being an accessory for a drinking vessel according to a ninth embodiment of the present invention, is shown in FIGS. 70 to 73, and generally designated as 900. It can be seen that the structure of the straw 900 is very similar to that of the straw 800 discussed above. The only main difference is that, in the straw 900, when a valve 908 is in a valve-closed configuration, a lower surface 916 of an upper valve membrane 910 contacts and overlaps an upper surface 914 of a lower valve membrane 912. When a suction force is applied on the straw 900 in the direction indicated by an arrow I in FIG. 73, the upper valve membrane 910 is caused to deform and bend away from the lower valve membrane 912 to open the valve 908, to allow air or liquid to pass through the valve 908.

Both the upper valve membrane 910 and lower valve membrane 912 are formed integrally with a circular wall 918 of a body 904 of the straw 900. It can also be seen from FIG. 73 that both the upper valve membrane 910 and lower valve membrane 912 are joined and integral with opposite sides of the wall 918.

Figure 74:
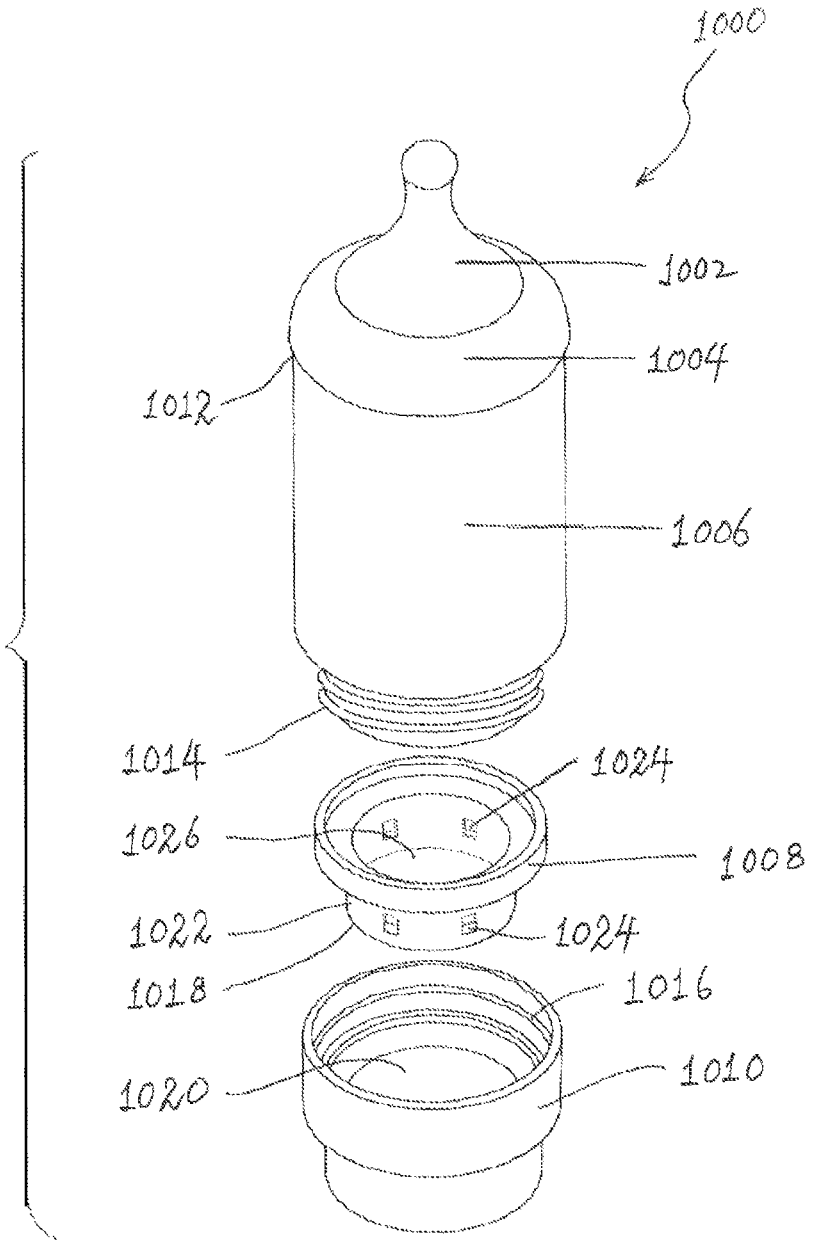
FIG. 74 is an exploded view of a bottle incorporating an accessory for a drinking vessel according to a tenth embodiment of the present invention.

An exploded perspective view of a drinking vessel in the form of a feeding bottle incorporating an accessory according to a tenth embodiment of the present invention is shown in FIG. 74, in which the feeding bottle is generally designated as 1000. The bottle 1000 includes a nipple 1002, a cover 1004, a bottle body 1006, an accessory 1008 which is made of silicone. and a bottom cover 1010.

While the nipple 1002 and the cover 1004 are here shown as fixedly engaged with each other and the cover 1004 and the bottle body 1006 are also shown here as fixedly engaged with each other, it is envisaged that the nipple 1002 may be releasably engaged with the cover 1004 and the cover 1004 may also be releasably engaged with the bottle body 1006.

Both an upper end 1012 and a lower end 1014 of the bottle body 1006 are open. As the bottle body 1006 is engaged with the nipple 1002, when the feeding bottle 1000 is duly assembled, liquid in the bottle body 1006 may be drawn out via the nipple 1002 by application of a suction force on the bottle body 1006 via the nipple 1002.

The lower end 1014 of the bottle body 1006 is externally threaded for forming releasable threaded engagement with an open internally threaded end 1016 of the bottom cover 1010. When duly assembled, the accessory 1008 is wholly received within an internal cavity 1020 of the bottom cover 1010, and the accessory 1008 is in engagement with and closes the lower open end 1014 of the bottle body 1006. As the accessory 1008 has a bottom wall 1018 and a circular endless wall 1022 adjoining each other, when the feeding bottle 1000 is duly assembled, the accessory 1008 forms a bottom of the bottle body 1006 for holding a liquid.

The accessory 1008 has a number of valves 1024 on its circular wall 1022. All these valves 1024 are designed to allow, in use, air from the outside environment to pass through to an internal cavity 1026 defined by the bottom wall 1018 and the circular wall 1022.

Figure 77:
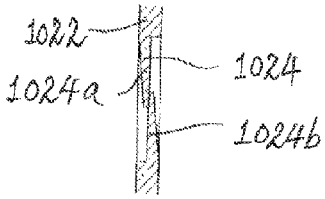
FIG. 77 is an enlarged view of an air vent on the accessory of the bottle of FIG. 74 in a valve-closed configuration.
Figure 78:
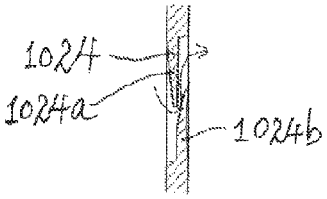
FIG. 78 is an enlarged view of the air vent of FIG. 77 in a valve-open configuration.

FIG. 77 shows one of the valves 1024 in a valve-closed configuration and FIG. 78 shows the valve 1024 in a valve-open configuration. The valve 1024 has two valve membranes 1024*a*, 1024*b*. The construction and relative positioning of the valve membranes 1024*a*, 1024*b* are similar to those in the other embodiments discussed above.

When the valve 1024 is in the valve-closed configuration as shown in FIG. 77, two oppositely-facing inner surfaces of the valve membranes 1024*a*, 1024*b* contact with and overlap each other. When a suction force is applied on the nipple 1002 of the feeding bottle 1000, the valve membrane 1024*b* will be forced to deform (in particular, bend away from the valve membrane 1024*a*) and be out of contact with the valve membrane 1024*a*, thus opening the valve 1024, as shown in FIG. 78, and allowing air to pass through.

Figure 75:
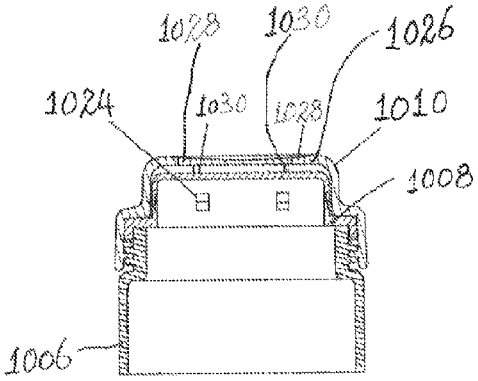
FIG. 75 is a longitudinal sectional view of a bottom portion of the bottle of FIG. 74 in an upside down orientation.

The bottom portion of the assembled feeding bottle 1000 is shown in an upside-down orientation in FIG. 75. The bottom cover 1010 is threadedly engaged with the bottle body 1006 with the accessory 1008 disposed therebetween. A bottom wall 1026 of the bottom cover 1010 has some holes 1028 allowing air from the outside environment to pass through the bottom wall 1026 into the internal cavity 1020.

On an inner side of the bottom wall 1026 of the bottom cover 1010 are two ridges 1030 which serve to separate the bottom wall 1018 of the accessory 1008 from the bottom wall 1026 of the bottom cover 1010. The accessory 1008 and the bottom cover 1010 are sized and configured such that when they are duly assembled as shown in FIG. 75, a space 1032 (see FIG. 80) exists between them such that the valves 1024 are in an air-communicable relationship with the holes 1028 (and thus with the outside environment) via the space 1032.

Figure 76:
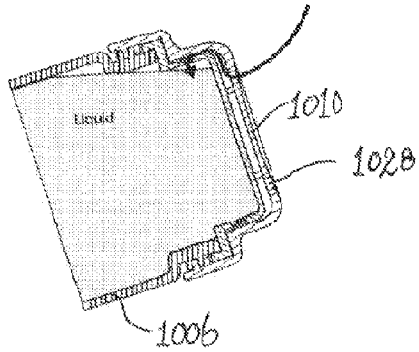
FIG. 76 is a further longitudinal sectional view of the bottom portion of the bottle of FIG. 75 in a slanted orientation.
Figures 79, 80:
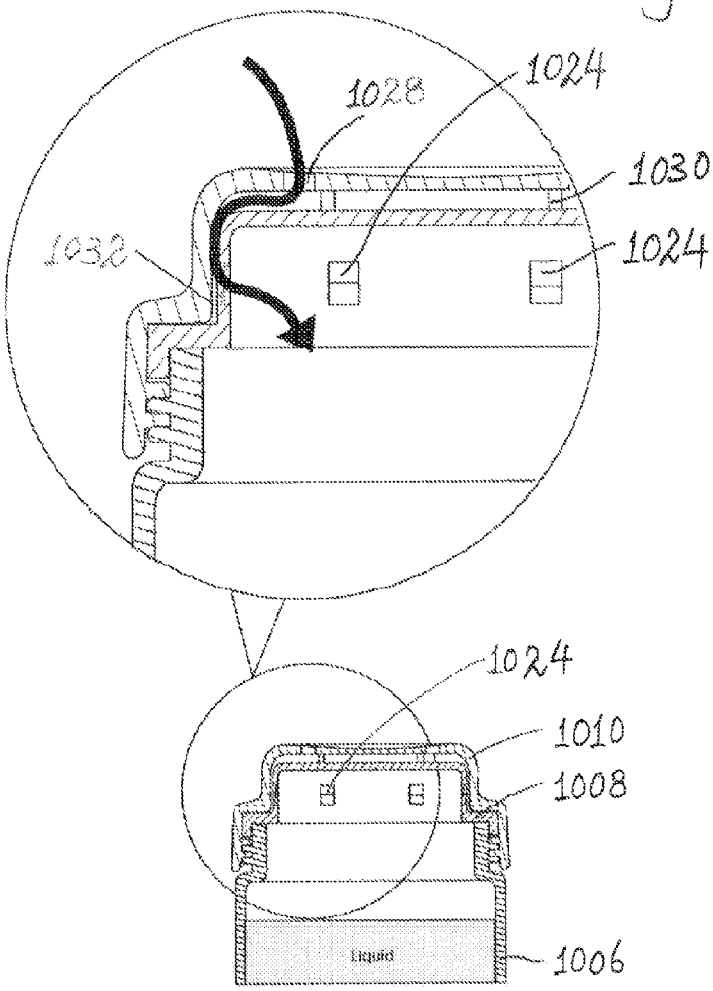
FIG. 79 is a further longitudinal sectional view of the bottom portion of the bottle of FIG. 75.
FIG. 80 is an enlarged view of the encircled part of FIG. 79.

As shown in FIGS. 76, 79 and 80, when liquid is drawn out of the feeding bottle 1000, e.g. upon sucking by a baby or toddler, the air pressure in the bottle body 1006 will fall below the atmospheric pressure. Because of the difference in air pressure, air from the outside environment will smoothly enter the holes 1028, the space 1032, the valves 1024 (which are open by reason of the difference of air pressure across the valves 1024), and eventually the interior cavity of the bottle body 1006, as shown by the arrows in FIGS. 76 and 80.

By way of such an arrangement, fewer air bubbles will form in the feeding bottle 1000, and thus a baby or toddler feeding from the feeding bottle will experience less discomfort of posseting. In addition, the feeding bottle 1000 possesses the following advantages:

i. as the inner surface of the accessory 1008 is flat, it is relatively easy to completely mix milk powder with water by a spoon or by rotating the bottle 1000;

ii. when feeding, the lower end of the bottle 1000 usually points upwardly. With the valves 1024 disposed close to the lower end of the bottle 1000, they can function even when the bottle body 1006 is almost full; and iii. as it is easy to detach the bottle body 1006, the accessory 1008 and the bottom cover 1010 from one another, it is easy to clean these components, in particular the valves 1024.

Figure 81:
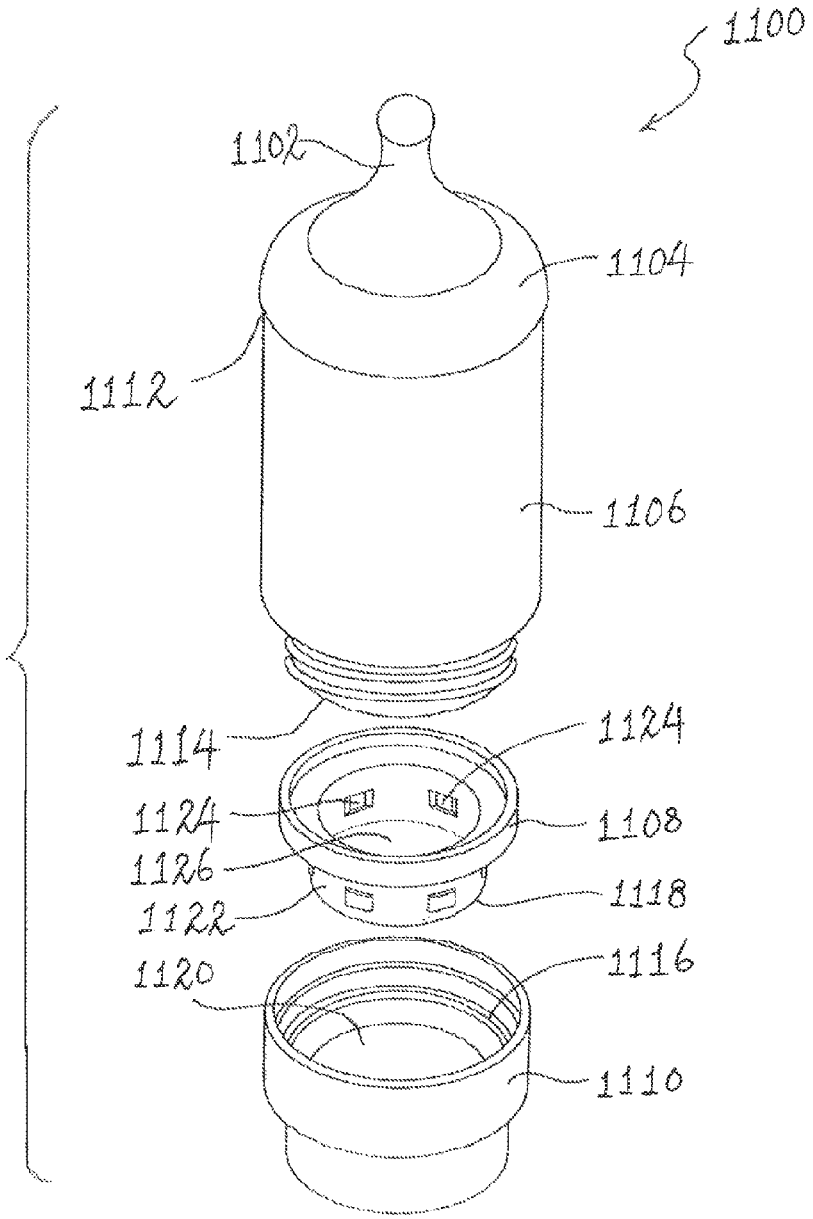
FIG. 81 is an exploded view of a bottle incorporating an accessory for a drinking vessel according to an eleventh embodiment of the present invention.

An exploded perspective view of a drinking vessel in the form of a feeding bottle incorporating an accessory according to an eleventh embodiment of the present invention is shown in FIG. 81, in which the feeding bottle is generally designated as 1100. The bottle 1100 includes a nipple 1102, a cover 1104, a bottle body 1106, an accessory 1108, and a bottom cover 1110.

While the nipple 1102 and the cover 1104 are here shown as fixedly engaged with each other and the cover 1104 and the bottle body 1106 are also shown here as fixedly engaged with each other, it is envisaged that the nipple 1102 may be releasably engaged with the cover 1104, and the cover 1104 may also be releasably engaged with the bottle body 1106.

Both an upper end 1112 and a lower end 1114 of the bottle body 1106 are open. As the bottle body 1106 is engaged with the nipple 1102, when the feeding bottle 1100 is duly assembled, liquid in the bottle body 1106 may be drawn out via the nipple 1102 by application of a suction force on the bottle body 1106 via the nipple 1102.

The lower end 1114 of the bottle body 1106 is externally threaded for forming releasable threaded engagement with an open internally threaded end 1116 of the bottom cover 1110. When duly assembled, the accessory 1108 is wholly received within an internal cavity 1120 of the bottom cover 1110, and the accessory 1108 is in engagement with and closes the lower open end 1114 of the bottle body 1106. As the accessory 1108 has a bottom wall 1118 and a circular endless wall 1122 adjoining each other, when the feeding bottle 1100 is duly assembled, the accessory 1108 forms a bottom of the bottle body 1106 for holding a liquid.

The accessory 1108 has a number of valves 1124 on its circular wall 1122. All these valves 1124 are designed to allow, in use, air from the outside environment to pass through to an internal cavity 1126 defined by the bottom wall 1118 and the circular wall 1122.

Figure 82:
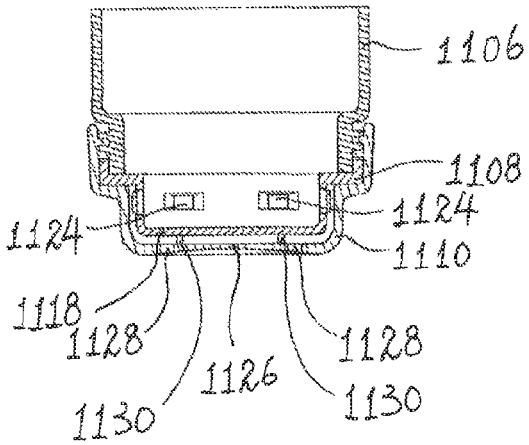
FIG. 82 is a longitudinal sectional view of a bottom portion of the bottle of FIG. 81.

The bottom portion of the assembled feeding bottle 1100 is shown in FIG. 82. The bottom cover 1110 is threadedly engaged with the bottle body 1106 with the accessory 1108 disposed therebetween. A bottom wall 1126 of the bottom cover 1110 has some holes 1128 allowing air from the outside environment to pass through the bottom wall 1126 into the internal cavity 1120.

On an inner side of the bottom wall 1126 of the bottom cover 1110 are two ridges 1130 which serve to separate the bottom wall 1118 of the accessory 1108 from the bottom wall 1126 of the bottom cover 1110. The accessory 1108 and the bottom cover 1110 are sized and configured such that when they are duly assembled as shown in FIG. 82, a space 1132 (see FIG. 85) exists between them such that the valves 1124 are in an air-communicable relationship with the holes 1128 (and thus with the outside environment) via the space 1132.

Figure 83:
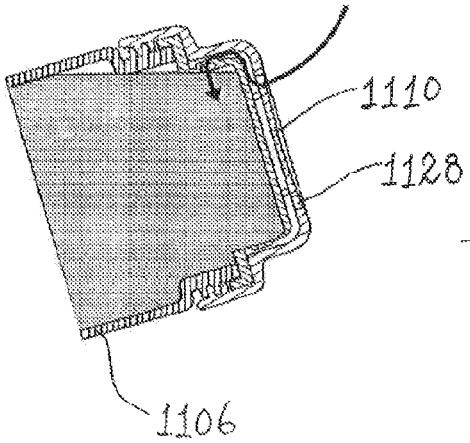
FIG. 83 is a further longitudinal sectional view of the bottom portion of the bottle of FIG. 81 in a slanted orientation.

As shown in FIGS. 83 to 85, when liquid is drawn out of the feeding bottle 1100, e.g. upon sucking by a baby or toddler, the air pressure in the bottle body 1106 will fall below the atmospheric pressure. Because of the difference in air pressure, air from the outside environment will smoothly enter the holes 1128, the space 1132, the valves 1124 (which are open by reason of the difference of air pressure across the valves 1124, in a manner to be discussed below), and eventually the interior cavity of the bottle body 1106, as shown by the arrows in FIGS. 83 and 85.

FIGS. 86 to 92 show various views of the accessory 1108, which is formed integrally in one piece, and is made of silicone or rubber like plastic material. When originally formed, and as shown in FIG. 93, the valve 1124 is not yet cut out, and is thus not yet operative. One may then form the valve 1124 by cutting open a connection between a first side valve membrane 1124*a* and a central valve membrane 1124*b* to form an openable air gap. It can be seen that the cross-section of the first side valve membrane 1124*a* is tapered (i.e, getting thinner) towards its free end which points towards the central valve membrane 1124*b*.

The first side valve membrane 1124*a* has an outward-facing major surface 1134*a* and an opposite inward-facing major surface 1134*b*. The central valve membrane 1124*b* also has an outward-facing major surface 1136*a* and an opposite inward-facing major surface 1136*b*.

In normal situation (i.e, when there is no sufficient pressure difference between the air pressure within the bottle body 1106 and that of the outside environment), the outward-facing major surface 1134 of the first side valve membrane 1124*a* contacts and overlaps with the inward-facing major surface 1136 of the central valve membrane 1124*b* to close the valve 1124 to prevent flow of air therethrough. When the accessory 1108 is installed in the bottle 1100, and when a suction force is applied on the bottle 1100 through the 1102 nipple, the air pressure within the bottle body 1106 is reduced below the atmospheric pressure. In this way, because of the pressure difference, and by virtue of the resilience of the first side valve membrane 1124*a*, the tapered end of the first side valve membrane 1124*a* will deform and move away from and out of contact with the inward-facing major surface 1136 of the central valve membrane 1124*b*, to open the valve 1124 to allow flow of air therethrough (in particular from the outside environment into the interior cavity of the accessory 1108), as shown in FIG. 94.

Figures 86, 87, 88, 89, 90, 91, 92, 93, 94, 95:
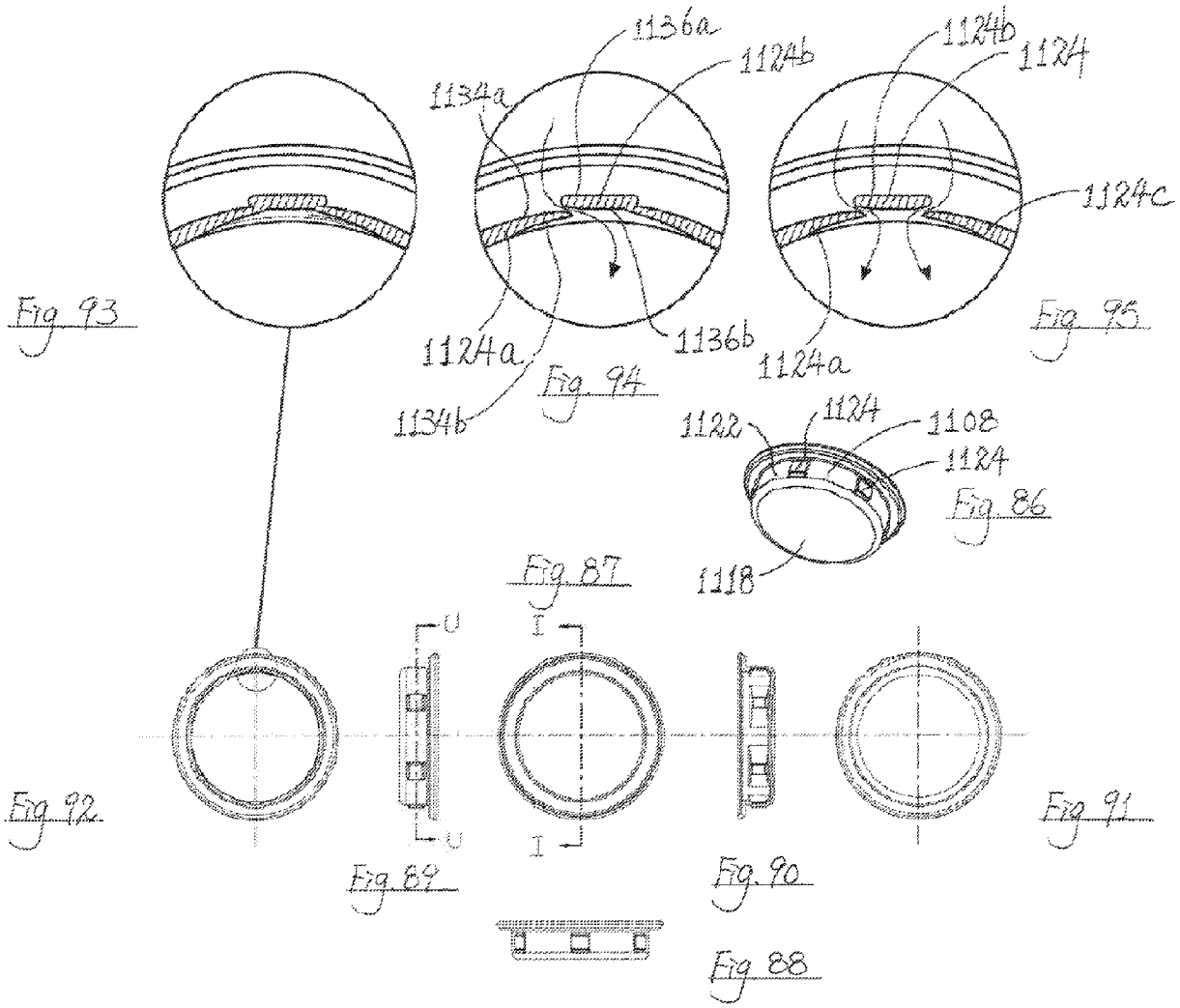
FIG. 86 is a bottom perspective view of the accessory of the bottle of FIG. 81.
FIG. 87 is a bottom view of the accessory of FIG. 86.
FIG. 88 is a front view of the accessory of FIG. 87.
FIG. 89 is a side view of the accessory of FIG. 87.
FIG. 90 is a sectional view taken along the line 1-1 of FIG. 87.
FIG. 91 is a top view of the accessory of FIG. 87.
FIG. 92 is a sectional view taken along the line U-U of FIG. 89.
FIG. 93 is an enlarged view of the encircled part of FIG. 92 when uncut.
FIG. 94 is an enlarged view of the encircled part of FIG. 92 when one gap is cut out.
FIG. 95 is an enlarged view of the encircled part of FIG. 92 when two gaps are cut out.
Figure 96:
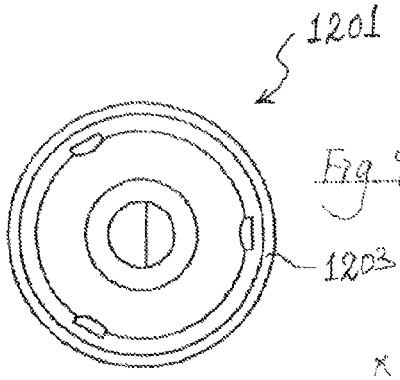
FIG. 96 is a top view of a teat for forming a lid, being an accessory for a drinking vessel according to a twelfth embodiment of the present invention.
Figure 98:
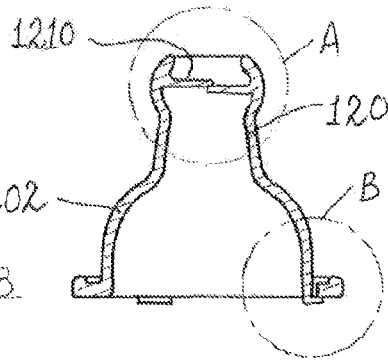
FIG. 98 is a sectional view taken alone the line X-X of FIG. 97.
Figure 97:
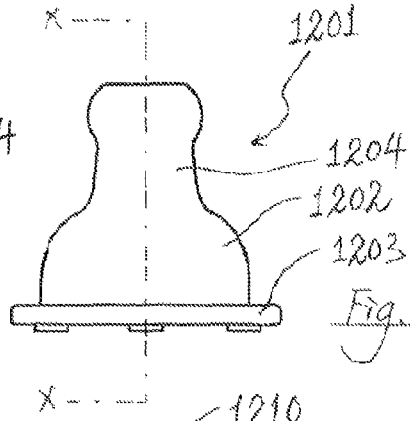
FIG. 97 is a side view of the teat of FIG. 96.

It is possible to increase the rate of flow of air from the outside environment through the valve 1124 by cutting open a connection between a second side valve membrane 1124*c* and the central valve membrane 1124*b*, as shown in FIG. 95. The construction of the second side valve membrane 1124*c* is identical with that of the first side valve membrane 1124*a*. By way of such an arrangement, air from the outside environment may pass through the valve 1124 via two openable air gaps, for example for further reducing posseting in babies.

FIGS. 96 to 100 show a teat (also called a "nipple"), generally designated as 1201, for forming a lid according to a twelfth embodiment of the present invention. This teat 1201 has a body 1202 made in one piece of silicone or rubber like plastic material. The body 1202 of the teat 1201 has an annular base rim 1203 and a spout 1204 extending therefrom. As shown in FIG. 107, the teat 1201 may be releasably engaged with a generally cylindrical cover 1206 to form a lid 1200. The lid 1200 is threadedly engaged with a bottle 1240 to form a spilled-proof bottle suitable for use by babies or toddlers.

At the top of the spout 1204 is formed a valve 1210. As shown more clearly in FIGS. 98 and 101, the valve 1210 has one upper valve membrane 1210*a* and one lower valve membrane 1210*b*. Each of the upper valve membrane 1210*a* and lower valve membrane 1210*b* has two ends which are fixed with and integrally formed with two opposite walls of the spout 1204. When the teat 1201 is originally formed, the upper valve membrane 1210*a* and the lower membrane 1210*b* are integrally connected with each other. One may then cut open the connection between the upper valve membrane 1210*a* and the lower valve membrane 1210*b* in such a way that part of a lower surface of the upper valve membrane 1210 contacts and overlaps with part of an upper surface of the lower valve membrane 1210*b* to form an openable valve, as shown in FIG. 101.

When the lid 1200 is engaged with the bottle 1240 to form a drinking vessel, upon application of a suction force through the valve 1210 of the spout 1204, the upper valve membrane 1210*a* deforms and moves away and out of contact from the lower valve membrane 1210*b* (see FIG. 103), thus forming a gap allowing the content in the drinking vessel to be sucked out through the gap between the deformed upper valve membrane 1210*a* and the lower valve membrane 1210*b*, as shown by the arrow in FIG. 103. Upon release of the suction force, the upper valve membrane 1210*a* will return to its normal un-deformed shape and position to resume contact and overlapping with part of the upper surface of the lower valve membrane 1210*b* to close the valve 1210, as shown in FIG. 105.

A number of vent holes 1208 are formed between the base rim 1203 and the body 1202 of the teat 1201, as shown clearly in FIGS. 102, 104 and 106. Each of the vent hole 1208 has a deformable valve membrane 1212 which is made of a resilient material (such as silicone or a rubber like plastic material). The valve membrane 1212 is movable between a vent-closed position as shown in FIGS. 102 and 106 in which it closes the vent hole 1208 by contacting and overlapping the base rim 1203 and a vent-open position as shown in FIG. 104 in which the valve membrane 1212 is out of contact with, and does not overlap, the base rim 1203.

When the lid 1200 incorporated with the teat 1201 is assembled with the bottle 1240 to form a drinking vessel (as shown in FIG. 107), and during operation of the lid 1200 in which a suction force is applied through the spout 1204, the internal air pressure in the drinking vessel is reduced. Because of the difference between the internal air pressure in the drinking vessel and the atmospheric pressure, the valve membrane 1212 will be deformed and moved from its vent-closed position as shown in FIG. 102 to the vent-open position as shown in FIG. 104, to open the vent hole 1208, allowing air from the atmosphere to enter the interior of the drinking vessel, in the direction indicated by the arrow in FIG. 104. When the suction force is removed, and when the internal air pressure in the drinking vessel is allowed to return to the atmospheric pressure, the valve membrane 1212 will return to the vent-closed shape and position as shown in FIG. 106, to which it is biased by reason of its own resilience, to close the vent hole 1208.

Figure 100:
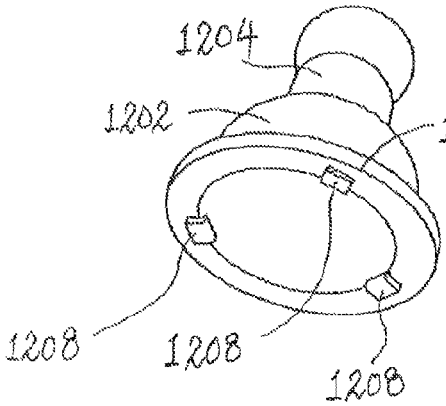
FIG. 100 is a bottom perspective view of the teat of FIG. 96.
Figure 99:
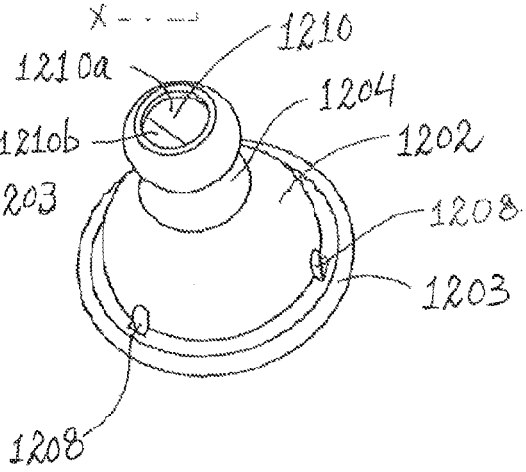
FIG. 99 is a top perspective view of the teat of FIG. 96.

As shown in FIG. 100, three vent holes 1208 are provided. However, one may decide the number of operable vent holes 1208. For example, one may only cut open the connection between the valve membrane 1212 and the base rim 1203 of one vent hole 1208 only, in which case only one vent hole 1208 is operative. If desired, one may make two vent holes 1208 operative only, or make all three vent holes 1208 operative.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. An accessory for a drinking vessel, said accessory comprising:

a body having a first wall and a second wall which are opposite to each other, at least one passageway formed therebetween for allowing air or liquid to pass therethrough, a first valve disposed in said passageway, wherein said first valve includes at least one first valve member and a second valve member, arranged such that at least a part of the first valve member overlaps at least a part of the second valve member, said first valve member being integrally formed with said first and second walls, and extending radially therefrom to at least partially block said passageway, said second valve member being integrally formed with said first and second walls, and extending radially therefrom to at least partially block said passageway, each of said first and second valve members including, respectively, an upper surface and a lower surface which are opposite to each other, wherein said upper surfaces of said first and second valve members face generally an outlet from said passageway, wherein said lower surfaces of said first and second valve members face generally an inlet to said passageway which is opposite to said outlet, and wherein said first valve member is deformable, said first valve to the passageway from a closed configuration in which at least part of said lower surface of said first valve member contacts and overlaps at least part of said upper surface of said second valve member to completely block the at least one passageway and prevent flow of air or liquid through said first valve into an open configuration in which said first valve member is displaced away by a suction force from said second valve member to form a channel between the part of the lower surface of the first valve member which is curved away from and out of contact with the part of the upper surface of the second valve member to allow air or liquid to flow through said channel to said outlet, said first valve member being biased towards said closed configuration.

2. The accessory according to claim 1 wherein said first valve member has a thicker portion which joins said first valve member to said first and second walls than a portion thereof forming said lower surface of said first valve member which contacts and overlaps said upper surface of said second valve member.

3. The accessory according to claim 1 wherein said first valve member is substantially flat when in said closed configuration and is curved when in said open configuration.

4. The accessory according to claim 1 wherein said first valve member is curved when in said closed configuration and in said open configuration.

5. The accessory according to claim 1 wherein said accessory is a lid, and wherein said body of said accessory includes a spout.

6. The accessory according to claim 5 wherein said second valve member has at least one hole which is covered by said first valve member when said first valve member is in said closed configuration.

7. The accessory according to claim 5 further comprising a plurality of deformable first valve members.

8. The accessory according to claim 7 wherein said second valve member has a plurality of holes which are covered by said plurality of first valve members when said first valve members are in said closed configuration.

9. The accessory according to claim 5 wherein said second valve member is formed integrally all-round with an inner surface of said spout.

10. The accessory according to claim 5 further comprising a second valve disposed in said passageway adapted to allow air to pass through.

11. The accessory according to claim 10 wherein said second valve includes a valve member which is movable between a closed position to prevent air to pass through said second valve and an open position to allow air to pass through said second valve.

12. The accessory according to claim 11 wherein said valve member of said second valve, when in said closed position, contacts and overlaps at least part of said body of said lid.

13. The accessory according to claim 5 wherein said accessory is made integrally in one piece.

14. The accessory according to claim 5 wherein said accessory is made of silicone or rubber like plastic material.

15. The accessory according to claim 5 wherein said accessory comprises at least two body members engaged with each other, wherein said first body member comprises said spout, and wherein said second body member forms a lid which is releasably engageable with an open upper end of a container to form a drinking vessel.

16. The accessory according to claim 15 wherein said first body member is made of a material which is softer than a material with which said second body member is made.

17. The accessory according to claim 5 wherein at least one rib member is formed on an upper surface of said spout.

18. The accessory according to claim 5 wherein said accessory includes a teat.

19. A drinking vessel comprising a container having an open upper end and an accessory according to claim 5 releasably engageable with said open upper end of said container.

20. The drinking vessel according to claim 19 wherein, when said accessory is engaged with said container, said first valve member is deformed from said closed configuration to said open configuration upon application of the suction force to the outlet of the at least one passageway, applied from an outside environment on said spout.

21. The drinking vessel according to claim 20 wherein said valve member of said second valve is moved from said closed position to said open position upon application of the suction force from the outside environment on said spout.

22. The accessory according to claim 1 wherein said accessory is a straw.

23. The accessory according to claim 1 wherein said accessory further comprises an endless wall member and a bottom wall member adjoining said endless wall member and collectively defining an internal cavity.

24. The accessory according to claim 23 wherein said first valve is located on said endless wall member and is adapted to allow air to pass through said first valve to said internal cavity.

25. The accessory according to claim 23 wherein a plurality of said first valves are located on said endless wall member.

26. The accessory according to claim 23 wherein said accessory is made integrally in one piece.

27. The accessory according to claim 24 wherein said accessory is made of silicone.

28. A drinking vessel comprising:

a container with an upper open end and a lower open end, the accessory according to claim 23 engagable therewith, and a cover.

29. The drinking vessel according to claim 28 wherein said cover is releasably engaged with said lower end of said container to engage said accessory with said lower end of said container.

30. The drinking vessel according to claim 29 wherein said accessory is wholly received within said cover.

31. The drinking vessel according to claim 28 wherein said cover is threadedly engaged with said lower end of said container.

32. The drinking vessel according to claim 28 wherein said cover includes at least one vent hole.

33. The drinking vessel according to claim 28 wherein a bottom of said accessory is spaced apart from a bottom of said cover by at least one ridge member.

34. The drinking vessel according to claim 32 wherein, in use, upon application of a suction force on said container via said upper end of said container, air is adapted to be drawn through said vent hole of said cover, and through said first valve of said accessory, into said container.

35. The drinking vessel according to claim 28 wherein, in use, upon application of the suction on said container via said upper end, liquid in said container is adapted to be drawn out from said container via said upper end.

36. The drinking vessel according to claim 28 wherein said accessory is releasably engaged with said lower end of said container to close said lower end of said container.

37. The accessory according to claim 1 wherein when said first valve member is in said closed configuration, said at least part of said lower surface of said first valve member contacts and overlaps said at least part of said upper surface of said second valve member at a plane which is substantially perpendicular to a longitudinal axis of said passageway.

* * * * *